US009822506B2

(12) United States Patent
Ding et al.

(10) Patent No.: US 9,822,506 B2
(45) Date of Patent: Nov. 21, 2017

(54) CONSTRUCTION SYSTEM FOR SUBWAY STATION

(71) Applicants: Guangzhou Jishi Construction Group Co., Ltd., Guangzhou, Guangdong (CN); Guangzhou Xinqiao Construction Service Co., Ltd., Guangzhou, Guangdong (CN)

(72) Inventors: Changyin Ding, Guangzhou (CN); Bingquan He, Guangzhou (CN); Dehui Ke, Guangzhou (CN); Muzhen Chen, Guangzhou (CN); Jin Mo, Guangzhou (CN); Pingyu Huang, Guangzhou (CN); Mingxi Jiang, Guangzhou (CN); Weicai Tang, Guangzhou (CN); Wenxian Li, Guangzhou (CN); Yuqi Li, Guangzhou (CN); Xiongwu Lei, Guangzhou (CN); Jiantao Qiu, Guangzhou (CN); Jianxin Qin, Guangzhou (CN); Wenlong Li, Guangzhou (CN); Shiliang Qiu, Guangzhou (CN); Dengjia He, Guangzhou (CN)

(73) Assignees: Guangzhou Jishi Construction Group Co., Ltd., Guangzhou (CN); Guangzhou Xinqiao Construction Service Co., Ltd., Guangzhou (CN)

( * ) Notice: Subject to any disclaimer, the term of this patent is extended or adjusted under 35 U.S.C. 154(b) by 214 days.

(21) Appl. No.: 14/608,249

(22) Filed: Jan. 29, 2015

(65) Prior Publication Data

US 2015/0211205 A1 Jul. 30, 2015

(30) Foreign Application Priority Data

Jan. 29, 2014 (CN) ..... 2014 1 0042907

(51) Int. Cl.
*E02D 29/05* (2006.01)
*E02D 29/00* (2006.01)
(Continued)

(52) U.S. Cl.
CPC ..... *E02D 29/04* (2013.01); *E21D 11/003* (2013.01); *E21D 11/10* (2013.01); *E21D 13/00* (2013.01)

(58) Field of Classification Search
CPC ..... E02D 29/045; E02D 29/12; E02D 29/05; E21D 11/40; E21D 9/02; E21D 9/10;
(Continued)

(56) References Cited

U.S. PATENT DOCUMENTS 1,746,566 A * 2/1930 Tufts ..... E02D 29/05 138/105
2,059,774 A * 11/1936 Caccia ..... E02D 29/05 405/138
(Continued)

FOREIGN PATENT DOCUMENTS

CN 201212150 Y 3/2009
CN 202945592 U 5/2013
CN 103276748 A 9/2013

OTHER PUBLICATIONS

Chen, Tingting, Construction Scheme Comparison Research of Subway Stations Based on AHP-TOPSIS, China Master Theses Electronic Journal, Jul. 15, 2012, pp. 11-14 and 19.
(Continued)

*Primary Examiner* — Benjamin Fiorello
*Assistant Examiner* — Edwin Toledo-Duran

(57) ABSTRACT

Described herein is a construction system for a subway station, wherein the construction of guide walls is accomplished using a guide wall steel formwork system, the construction of support beams is accomplished using a
(Continued)

support beam steel formwork system, the construction of sidewalls is accomplished using a sidewall trolley, and the construction of floor slabs is accomplished using a floor slab trolley.

9 Claims, 16 Drawing Sheets

(51) Int. Cl.
*E21D 13/00* (2006.01)
*E21D 11/00* (2006.01)
*E21D 11/10* (2006.01)

(58) Field of Classification Search
CPC ..... E21D 9/06; E21D 9/0607; E21D 11/00; F16L 55/16
USPC ..... 405/132–153
See application file for complete search history.

(56) References Cited

U.S. PATENT DOCUMENTS 3,210,903 A * 10/1965 Herolf ..... E04B 1/35 264/31
3,429,092 A * 2/1969 Hart ..... E04B 1/20 52/236.7
3,490,605 A * 1/1970 Koss ..... E01D 21/00 14/77.1
3,692,446 A * 9/1972 Vanderklaauw ..... E04B 1/3511 264/34
3,754,066 A * 8/1973 Black ..... B28B 19/0023 249/15
3,828,513 A * 8/1974 Vanderklaauw ..... E04B 1/3511 52/123.1
3,914,946 A * 10/1975 Bingham ..... E02D 29/05 404/71
3,921,362 A * 11/1975 Ortega ..... E04B 1/3538 52/125.1
3,985,480 A * 10/1976 Finsterwalder ..... E01D 21/105 249/20
3,999,394 A * 12/1976 Eberhardt ..... E02D 29/05 404/71
4,003,541 A * 1/1977 Lanier ..... E04G 11/38 249/18
4,008,577 A * 2/1977 Bingham ..... E02D 29/05 404/71
4,036,466 A * 7/1977 Van Meter ..... E04G 11/38 182/182.4
4,349,491 A * 9/1982 Eyden ..... E04G 17/16 249/187.1
4,403,460 A * 9/1983 Hills ..... E04B 1/3505 264/33
4,497,153 A * 2/1985 Muller ..... E01D 21/00 14/77.1
4,507,069 A * 3/1985 Murray ..... E02D 3/12 264/33
4,725,168 A * 2/1988 Fagundes ..... E02D 5/74 248/289.11
4,809,814 A * 3/1989 St-Germain ..... E04G 1/20 182/118
4,982,538 A * 1/1991 Horstketter ..... B28B 23/00 52/236.8
5,135,328 A * 8/1992 Chen ..... E02D 27/20 405/133
5,218,795 A * 6/1993 Horstketter ..... B28B 23/00 52/125.5
5,474,399 A * 12/1995 Chia-Hsiung ..... E02D 27/00 405/133
5,871,307 A * 2/1999 Catalano ..... E02D 5/20 405/267
6,247,273 B1 * 6/2001 Nickel ..... E04G 17/14 182/230
6,260,311 B1 * 7/2001 Vladikovic ..... E04G 11/28 249/20
2009/0288355 A1 * 11/2009 Platt ..... E04B 5/23 52/223.1
2014/0050531 A1 * 2/2014 Mancini ..... E21D 1/00 405/133

OTHER PUBLICATIONS

1st Office Action of counterpart Chinese Patent Application No. 201410042907.4 dated Nov. 25, 2014.

* cited by examiner

CONSTRUCTION SYSTEM FOR SUBWAY STATION

CROSS-REFERENCE TO PRIOR APPLICATION

The present application claims the priority of Chinese Patent Application No. 201410042907.4 filed on Jan. 29, 2014, the entirety of which is incorporated herein by reference.

FIELD OF THE INVENTION

The present application relates to a construction system for a subway station, particularly to construction of guide walls for underground continuous walls, construction of concrete support beam of foundation pit, construction of subway station sidewalls, and construction of subway station floor slabs.

BACKGROUND OF THE INVENTION

Currently, in construction of concrete structures of a subway station, it is most often to employ a construction method using wood formwork combined with respective bracket system, which leads to drawbacks such as few formwork cycle times, high cost, huge labor amount, long construction duration, etc. Specifically, the drawbacks are as follows:

(1) In a conventional construction process of guide walls for underground continuous walls, mounting is usually performed using a wood formwork, the overall rigidity of which is reinforced by using steel pipes, square timber, shaped steel and the like as back ribs, and then a rod member is used as a support so as to fix the formwork in place. The problem is that, since the components are all separated, every single component needs to be assembled and disassembled for each use, and is then moved manually to a next working site for a next cycle operation. Some of the continuous walls have great lengths, for example up to 1000 meters, and the construction duration is short. In such cases, if a wood formwork is used according to conventional processes, a large amount of material is to be used, and a labor-intensive and time-consuming assembling and disassembling is to be performed. Moreover, a common formwork is usually small, and therefore high accuracy is required in mounting and calibrating.

(2) In a conventional formwork for concrete support beam, mounting is usually performed using artificial wood formwork alone or combination of steel formwork and counter rod. When a wood formwork is used for mounting, since expansion joints of a wood formwork are big, slurry leakage is likely to occur, flatness of the concrete is difficult to achieve, stability of the support system is poor, the concrete quality is hard to control, and the formwork cannot be dissembled in advance and is used in a large number. When small steel formworks are used for mounting, since a plurality of them are pieced together, the seamings are difficult to treat, thereby increasing labor intensity. In a conventional formwork process, it is required to pre-burry plastic tubes of counter rod in the steel bar reinforced concrete in large numbers. The procedure is complicated, and usually leads to spatial interference between counter rods and the steel bars in the concrete, poor reliability, and high aspect ratio. In such cases, the formwork itself tends to twist, does not have sufficient strength to be a strong support, and is subject to lateral torsion when bearing high pressure after the concrete is cast. In the case of an excessive deformation, the requirement of a support beam cannot be met, and even crack and slurry leakage could occur at the connecting point and thus inclined supports need to be provided at two sides of the support beam formwork.

(3) In the concrete construction of conventional station sidewalls and floor slabs, full-framing method is used combined with wood formwork. In this process, it is needed to build a steel-pipe bracket in the foundation pit with a same width, and piece the wood formwork together piece by piece. The piecing of the steel-pipe bracket requires huge amount of labor and takes a long period of time. In the mounting of a wood formwork, operation space is limited, working environment is bad and piecing of the formwork is slow. Construction quality of the formwork and steel-pipe bracket could hardly be ensured and reliability is low. When the concrete is cast, deformation of sidewalls and slurry leakage of the concrete are likely to occur. It takes multiple operations to piece the wood formwork together, resulting in poor flatness of the concrete surface and possible height difference across the seaming. As for the components for cycle use, such as wood formwork and its bracket, the disassembly process is time consuming, the cycle period is long, and the components are often used in a large quantity. Furthermore, high skill and intensive labor and thus a large number of workers is required, with the disadvantages of low efficiency and high labor cost.

SUMMARY OF THE INVENTION

The present invention is to provide a construction system for a subway station. In the construction system, construction of a guide wall is accomplished using a guide wall steel formwork system, construction of a support beam is accomplished using support beam steel formwork system, construction of a sidewall is accomplished using sidewall trolley, and construction of a floor slab is accomplished using floor slab trolley. With the construction system of the present invention, construction procedures are significantly simplified, with increased construction efficiency and improved quality. Furthermore, the construction system of the present invention saves labor and consumables, lowering construction cost.

In order to achieve the goal above, an embodiment of the present invention provides a construction system for a subway station, comprising constructing a guide wall, constructing an underground continuous wall, excavating a first layer of earth, constructing a first concrete support beam, excavating a second layer of earth, constructing a second concrete support beam, . . . , excavating an $N^{th}$ layer of earth, constructing a steel support, constructing a bottom slab, dismantling the steel support, constructing a sidewall and a column of an underground $N-1^{th}$ storey, constructing a floor slab of the underground $N-1^{th}$ storey, dismantling an $N-1^{th}$ concrete support beam, constructing a sidewall and a column of an underground $N-2^{th}$ storey, constructing a floor slab of the underground $N-2^{th}$ storey, . . . , dismantling the second concrete support beam, constructing a sidewall and a column of an underground first storey, constructing a floor slab of the underground first storey, and dismantling the first concrete support beam; wherein an enclosure-and-protection structure of the subway station is formed after the step of constructing the steel support is complete, and a main structure of the subway station is formed after the step of dismantling the first concrete support beam is complete; wherein the step of constructing the guide wall is performed by making the guide wall into a "ㄱㄱ" shaped cast-in-place steel reinforced concrete structure using a guide wall steel formwork system; the step of constructing the underground continuous wall is performed by casting concrete down along the guide wall to form a concrete wall structure, the step of constructing the support beam is performed by using a support beam steel formwork system to make the support beam into a cast-in-place steel reinforced concrete structure, the support beam comprising a primary beam at a middle part thereof and two inclined beams at two ends thereof, the support beam being braced between two opposite underground continuous walls; the step of constructing the sidewall is performed by using a sidewall trolley provided with a sidewall trolley moving and fixing system and a sidewall steel formwork connecting and positioning system to cast a layer of steel reinforced concrete structure on an inner surface of the underground continuous wall; the step of constructing the floor slab is performed by using a floor slab trolley provided with a floor slab trolley moving and fixing system and a floor slab steel formwork connecting and positioning system to cast a steel reinforced concrete structure having one or more interlayers between two opposite underground continuous walls.

As a development of the technical solution stated above, the guide wall steel formwork system comprises two guide wall steel formworks arranged parallel and opposite to each other, and a movable hoisting mechanism for the guide wall steel formworks; an inner surface of each of the guide wall steel formworks is fixedly provided with a grid reinforcement rib, a surface of a side of the grid reinforcement rib is fixedly connected with a reinforcement through beam, the reinforcement through beam is provided with a U-shaped clamp, the two guide wall steel formworks are supported and connected by a plurality of jack screws provided transversely and inclinedly, two ends of each of the jack screws are respectively pin-connected with two U-shaped clamps; the movable hoisting mechanism for the guide wall steel formworks comprises a gantry having a gantry cross beam, and a crane mounted below the gantry cross beam, wherein the gantry has a column, a bottom of the column is provided with a running wheel; the step of constructing the guide wall comprises the following steps: step (1): leveling the ground, excavating a foundation trench and binding reinforcing steel bars at two sides of the foundation trench, step (2): after the step (1) is complete, hoisting the guide wall steel formwork system to the construction site of the guide wall, and coating the two guide wall steel formworks with a release agent, step (3): after the step (2) is complete, placing the two guide wall steel formworks under the movable hoisting mechanism, passing a steel cable through the U-shaped clamp on a transverse rib of the grid reinforcement rib, connecting the steel cable to the crane, hoisting the guide wall steel formworks using a pulley block, moving the movable hoisting mechanism hanging the guide wall steel formworks to a standard construction site of the guide wall, and placing the guide wall steel formworks into the foundation trench, step (4): after the step (3) is complete, adjusting the length of the jack screws to move the guide wall steel formwork to a predetermined distance from a corresponding inner wall of the foundation trench, locking the jack screws so as to fix the guide wall steel formworks, disengaging the steel cable, and moving the movable hoisting mechanism to continue to hoist a next set of guide wall steel formworks, step (5): after the step (4) is complete and when a second set of guide wall steel formworks is moved to a standard construction site, adjusting the position of the second set of guide wall steel formworks according to the first set of guide wall steel formworks so as to make them aligned with each other, step (6): after the step (5) is complete and when the two sets of guide wall steel formworks are aligned with each other, filling the space between the two sets of guide wall steel formworks, step (7): after the step (6) is complete, repeating the above steps till a preset number of guide wall steel formworks have been mounted, and step (8): after the step (7) is complete, casting concrete, disassembling the guide wall steel formworks after the concrete is solidified, and turning to a next construction cycle.

As a development of the technical solution stated above, the support beam steel formwork system comprises a support beam steel formwork consisting of steel plates arranged parallel and opposite to each other, the support beam steel formwork comprises a primary beam steel formwork located in the middle part thereof and two inclined support beam steel formworks located at the two ends thereof, the support beam steel formwork is provided with foot supports which can be locked to the ground, the steel plates arranged parallel and opposite to each other are supported and connected by a jack screw arranged in an upper part of the steel plates, the support beam steel formwork is provided with an outer support frame which can support and abut the support beam steel formwork, the outer support frame comprises a gantry having a gantry cross beam and a column and a support rod assembly mounted across the column of the gantry for supporting the support beam steel formwork, wherein the support rod assembly comprises a support plate for abutting the support beam steel formwork and a support rod for accommodating the forward and backward movements of the support plate, the support plate is connected to an end of the support rod, the support rod is a screw passing through and threaded with the column; the step of constructing the support beam comprises the following steps: step (1): excavating the earth to a predetermined depth, leveling the ground, providing a base pad for the support beam to be constructed, and binding reinforcing steel bars, step (2): after the step (1) is complete, hoisting the support beam steel formwork system to a construction site of the support beam, and coating the steel plates with a release agent, step (3): after the step (2) is complete, hoisting the steel plates to a standard construction site of support beam, hoisting and piecing together the steel plates simultaneously, wherein the hoisting and piecing together of the steel plates are started from the construction of the inclined support beam steel formwork, step (4): after the step (3) is complete, mounting the jack screw, which is in a loosened state after the mounting, and then making adjustment from the two ends of the support beam steel formwork towards the middle part thereof, till the adjustment is made properly, step (5): after the step (4) is complete, placing the outer support frame on the support beam steel formwork, pressing the gantry cross beam just on the support beam steel formwork, making the column of the gantry of the outer support frame in contact with the ground, and then adjusting the support rod to make the support plate abut the support beam steel formwork and thus the latter is prevented from moving, step (6): after the step (5) is complete, tightening the jack screw to finish the mounting of the support beam steel formwork, and step (7): after the step (6) is complete, casting concrete, and disassembling the support beam steel formwork.

As a development of the technical solution stated above, the sidewall trolley is a sidewall trolley unit or a combination of a plurality of sidewall trolley units pieced together longitudinally, wherein the sidewall trolley moving and fixing system of the sidewall trolley comprises a base provided with a steel column, a beam-frame assembly movably connected to the steel column, and a running system mounted below the base; two ends of the beam-frame assembly along the longitudinal axis are provided with protrusions each protruding from a middle part of the end's surface, below the protrusions are provided with a plurality of screw jacks for vertical movement of the beam-frame assembly, the screw jacks are fixed on the steel column of the base, and a bottom of the beam-frame assembly is provided with a plurality of bearing jacks, wherein the sidewall steel formwork connecting and positioning system of the sidewall trolley comprises a sidewall steel formwork formed by a plurality of steel plates which are pieced together and fixed on a formwork frame, and a plurality of telescopic cantilevers which are fixedly mounted to a side of an upper part of the beam-frame assembly which side faces the sidewall under construction; an upper longitudinal beam of the formwork frame is pin-connected with free ends of the telescopic cantilevers, a plurality of hydraulic jacks are provided between a middle longitudinal beam of the formwork frame and the beam-frame assembly, and a plurality of lateral jack screws arranged longitudinally are provided between the sidewall steel formwork and the beam-frame assembly; wherein the step of constructing the sidewall comprises the following steps: step (1): laying a running track on the ground, step (2): after the step (1) is complete, coating the sidewall steel formwork with a release agent, step (3): after the step (2) is complete, placing a counterweight at a side of the sidewall trolley opposite to the sidewall steel formwork, putting the sidewall trolley on the running track, step (4): after the step (3) is complete, adjusting the screw jacks to align a lower edge of the sidewall steel formwork with a positioning line, step (5): after the step (4) is complete, repeatedly adjusting the telescopic cantilevers and the hydraulic jacks to position the sidewall steel formwork in place, step (6): after the step (5) is complete, adjusting the bearing jacks to fix the sidewall trolley, step (7): after the step (6) is complete, mounting the lateral jack screws to fix the sidewall steel formwork, step (8): after the step (7) is complete, mounting a plurality of anchor cables between a pre-buried ground anchor and the sidewall trolley, and tensioning the anchor cables towards the sidewall that is under construction, step (9): after the step (8) is complete, mounting a plurality of anti-floating jack screws to abut one end of each of the anti-floating jack screws to a top of the sidewall steel formwork and the other end to a bottom of a support beam, step (10): after the step (9) is complete, mounting high ribbed formworks and water-stop steel plates at two longitudinal sides of the sidewall steel formwork, and step (11): after the step (10) is complete, casting concrete, disassembling the sidewall steel formwork after the concrete is solidified, and turning to a next construction cycle.

As a development of the technical solution stated above, two sidewall trolleys are used simultaneously for constructing two opposite sidewalls, the two sidewall trolleys are connected by a plurality of bracing tubes, wherein a step as follows is comprised between the step (9) and the step (10): assembling the plurality of bracing tubes between two parallel sidewall trolleys.

As a development of the technical solution stated above, the beam-frame assembly is formed with an upper beam-frame assembly and a lower beam-frame assembly in an overlapped way, wherein the upper beam-frame assembly is connected with the lower beam-frame assembly by means of bolts.

As a development for the technical solution stated above, the floor slab trolley is a floor slab trolley unit or a combination of a plurality of floor slab trolley units pieced together, wherein the floor slab trolley moving and fixing system of the floor slab trolley comprises a base provided with a steel column, a beam-frame assembly movably connected to the steel column, and a running system mounted below the base; wherein the beam-frame assembly comprises an upper frame and a lower longitudinal beam, two ends of the upper frame along the longitudinal axis are provided with protrusions each protruding from a middle part of the end's surface, below the protrusions are provided a plurality of first hydraulic jacks for vertical movement of the beam-frame assembly, the first hydraulic jacks are fixed on the steel column of the base, and below the lower longitudinal beam are provided with a plurality of bearing jacks, wherein the floor slab steel formwork connecting and positioning system of the floor slab trolley comprises a floor slab steel formwork formed by a plurality of steel plates which are pieced together and fixed on a formwork frame, a plurality of roller supports mounted below a back longitudinal beam of the floor slab steel formwork, a plurality of transverse tracks provided on the top of the beam-frame assembly and movably connected with the roller supports, and a plurality of second hydraulic jacks mounted on the top of the beam-frame assembly for transverse movement of the floor slab steel formwork; wherein free ends of the second hydraulic jacks are hinged with the back longitudinal beam of the floor slab steel formwork, wherein the floor slab steel formwork is a lateral formwork having a formwork at one side thereof for the construction of the sidewall or a longitudinal beam, or the floor slab steel formwork is a middle formwork having widened formworks at both sides thereof; wherein the lateral formwork is provided with a body and a lateral part arranged at one side of the body, the lateral part is movably connected with the body through a hinge; a plurality of jack screws and a plurality of third hydraulic jacks are provided between the lateral part and the upper frame of the beam-frame assembly; the middle formwork comprises a body and cantilevered parts arranged at two sides of the body, the cantilevered parts are fixedly connected with the body through bolts; a plurality of jack screws are provided between the cantilevered parts and the upper frame of the beam-frame assembly; the step of constructing the floor slabs comprises the following steps: step (1): laying a running track on the ground, step (2): after the step (1) is complete, installing a floor slab trolley provided with the lateral formwork adjacent to the sidewall or the longitudinal beam, installing a floor slab trolley provided with the middle formwork for construction of a middle portion of the floor slab, step (3): after the step (2) is complete, adjusting the elevation of the floor slab trolleys through the first hydraulic jacks and the bearing jacks to make top surfaces of the floor slab steel formworks of different floor slab trolleys be on a same plane, step (4): after the step (3) is complete, performing transverse piecing of the floor slab steel formworks among the floor slab trolleys by adjusting the second hydraulic jacks, step (5): after the step (4) is complete, performing positioning of the lateral part of the lateral formwork by adjusting the third hydraulic jacks, step (6): after the step (5) is complete, fixing the floor slab steel formworks by mounting the jack screws, step (7): after the step (6) is complete, connecting two parallel floor slab trolleys through a plurality of lateral jack screws or bracing steel rods positioned therebetween, step (8): after the step (7) is complete, binding reinforcing steel bars and mounting high ribbed formworks and water-stop steel plates, step (9): after the step (8) is complete, casting concrete, disassembling the floor slab steel formworks after the concrete is solidified, and turning to a next construction cycle.

As a development for the technical solution stated above, in each construction cycle, when the strength of the concrete at different locations of the floor slab reaches a designed value, the disassembling of the floor slab steel formwork is first accomplished for the floor slab trolley provided with the lateral formwork, and then the floor slab trolley provided with the lateral formwork is moved to a next construction cycle; when the strength of the solidified concrete reaches 100% of full strength, the floor slab trolley provided with the middle formwork is disassembled and is then moved to a next construction cycle.

As a development for the technical solution stated above, when the floor slab trolley is used for construction of a load-bearing floor slab, a post-disassembling formwork bracket is used to replace the floor slab trolley provided with the middle formwork.

As a development for the technical solution stated above, in each construction cycle, when the strength of the concrete at different locations of the floor slab reaches a designed value, the disassembling of the floor slab steel formwork is first accomplished for the floor slab trolley provided with the lateral formwork, and before disassembling the lateral formwork of the floor slab trolley provided with the lateral formwork in a construction section of the subway station, an installing of the post-disassembling formwork bracket is accomplished in a next construction section of the subway station, and the post-disassembling formwork bracket is retained until the construction of the floor slab in an upstairs storey is accomplished.

As a development for the technical solution stated above, an upper section of the upper frame is an overlappable frame.

In practicing the embodiments of the present invention, the following advantages are apparent:

(1) For the guide wall steel formwork system of the present invention used for construction of guide walls of underground continuous walls for a long and large foundation trench, the grid reinforcement rib and the reinforcement through beam provided on the inner side of the guide wall steel formwork maintain the overall rigidity and stability of the guide wall steel formwork, ensuring molding precision. The screw support provided at the inner sides connects the formworks at two sides to form an integral body as a complete formwork, and can be conveniently adjusted for formwork assembly and disassembly, enabling fast and convenient assembly and disassembly. Consequently, labor hour is reduced, assembly and disassembly are simplified, and labor cost is lowered. The guide wall steel formwork can be repeatedly used in construction of guide walls of underground continuous walls of the same or similar specification, thereby saving material cost.

(2) For the support beam steel formwork system of the present invention used for construction of support beam of subway foundation pit, the support beam steel formwork is formed by combining large steel formworks arranged parallel and opposite to each other and is preferably made of all-steel large formworks. The support beam steel formwork may be provided with foot supports at the bottom thereof locked to the ground, and is abutting at the top thereof via jack screws. Further, an outer support frame may be provided at the outer side of the support beam steel formwork which may abut against the support beam steel formwork. The foot supports, the jack screws and the outer support frame constitute a closely connected and supplementary whole, thereby effectively supporting and fixing the support beam steel formwork. In this way, the resultant support beam steel formwork is resistant to deformation and has an improved integrity, thereby significantly improving the quality of the cast concrete, and effectively avoiding the occurrence of structural deformation during concrete casting.

(3) For the sidewall trolley of the present invention used for construction of the sidewall in a subway station, track trolleys are used instead of bracket jackings of steel tubes, and large steel formworks are used instead of formworks which need to be pieced together one by one, whereby there is no need to build brackets of steel tubes and to piece formworks together, which significantly simplifies construction procedures, improves speed and reliability of the mounting of formworks, increases construction efficiency and reduces labor intensity. In this way, much less labor and materials like wood and steel tubes are needed, lowering construction cost. The sidewall steel formwork can be moved by telescopic movement of the telescopic cantilever and the hydraulic jacks, whereby adjusting of longitudinal position of the sidewall steel formwork during its positioning can be controlled, and automatic formwork assembly and disassembly can be achieved. The beam-frame assembly is moved vertically by the screw jacks provided below the lintel end of the beam-frame assembly, so as to control the adjusting of vertical position of the sidewall steel formwork during its positioning. With a running system mounted below the base, the beam-frame assembly can be brought into a longitudinal movement, thereby controlling adjusting of longitudinal position of the sidewall steel formwork during its positioning. Therefore, with the present invention, precise positioning in three directions can be achieved in a quick manner. With constructions of sidewalls at two sides performed simultaneously, the two sidewall trolleys are connected to form an integral body via bracing tubes. Lateral support of the sidewall trolley and simultaneous constructions of the sidewalls at two sides can be achieved, thereby improving structural stability of the sidewall trolley as well as construction efficiency. Meanwhile, by means of effective combination of bearing jacks, lateral jack screws, ground anchors and anti-floating jack screws, loads are effectively supported and transferred, thereby substantially improving overall stability of the trolley and construction quality. With a combination of units in vertical and longitudinal directions, the present invention is adapted for large-area sidewall constructions of different heights and lengths. The concrete surface is highly flat, height difference across the seaming is slight, and there is no slurry leakage.

(4) For the floor slab trolley of the present invention used for a subway station, horizontal movement of the floor slab steel formwork relative to the trolley is achieved by the second hydraulic jacks, whereby adjusting of transversal position of the floor slab steel formwork during its positioning can be controlled. Vertical movement of the beam-frame assembly is achieved by the first hydraulic jacks, whereby adjusting of vertical position of the floor slab steel formwork during its positioning can be controlled. Stable longitudinal movement of the beam-frame assembly is achieved via the running system below the base, whereby adjusting of longitudinal position of the floor slab steel formwork during its positioning can be controlled. Also, the floor slab trolley and the floor slab steel formwork are fixed by fixing components like bearing jacks, bracing steel rods and jack screws, whereby loads are supported and transferred, thus significantly improved construction quality and safety. Therefore, the present invention enables precise positioning in three directions, fast adjusting and stable structure. Furthermore, the floor slab steel formwork can be a lateral formwork or a middle formwork depending on construction conditions, and adapts to construction of floor slabs with different widths by different combinations of trolley and trolley or trolley and post-disassembling formwork bracket. What's more, the present invention is suitable for construction of large-area floor slabs having different lengths and different heights, by combining a plurality of units along the longitudinal direction and overlappable frames along the vertical direction. Finally, tracks and trolleys are used instead of brackets of steel tubes and jackings, and large steel formworks are used instead of formworks which need to be pieced together one by one, whereby there is no need to build brackets of steel tubes and to piece formworks together, which significantly simplifies construction procedures, improves speed and reliability of the mounting of formworks, increases construction efficiency and reduces labor intensity. In this way, much less labor and materials like wood and steel tubes are needed, lowering construction cost.

BRIEF DESCRIPTION OF THE DRAWINGS

In order to clearly explain the technical solution of the present invention as well as the prior art, the drawings illustrative of the embodiments and the prior art are described briefly in the following. It is to be understood that, the drawings in the following description are only illustrative of some embodiments, and based on these drawings, one skilled in the art can readily obtain other drawings without any creative effort.

DETAILED DESCRIPTION OF ILLUSTRATED EMBODIMENTS

The technical solutions of the embodiments of the present invention are described clearly and completely in the following, in conjunction with the drawings of the embodiments, the embodiments described being only some but not all of the embodiments of the present invention. Based on the embodiments described in the present invention, one skilled in the art can make other embodiments without an inventive step, all falling within the protection scope of the present invention.

Figure 1:
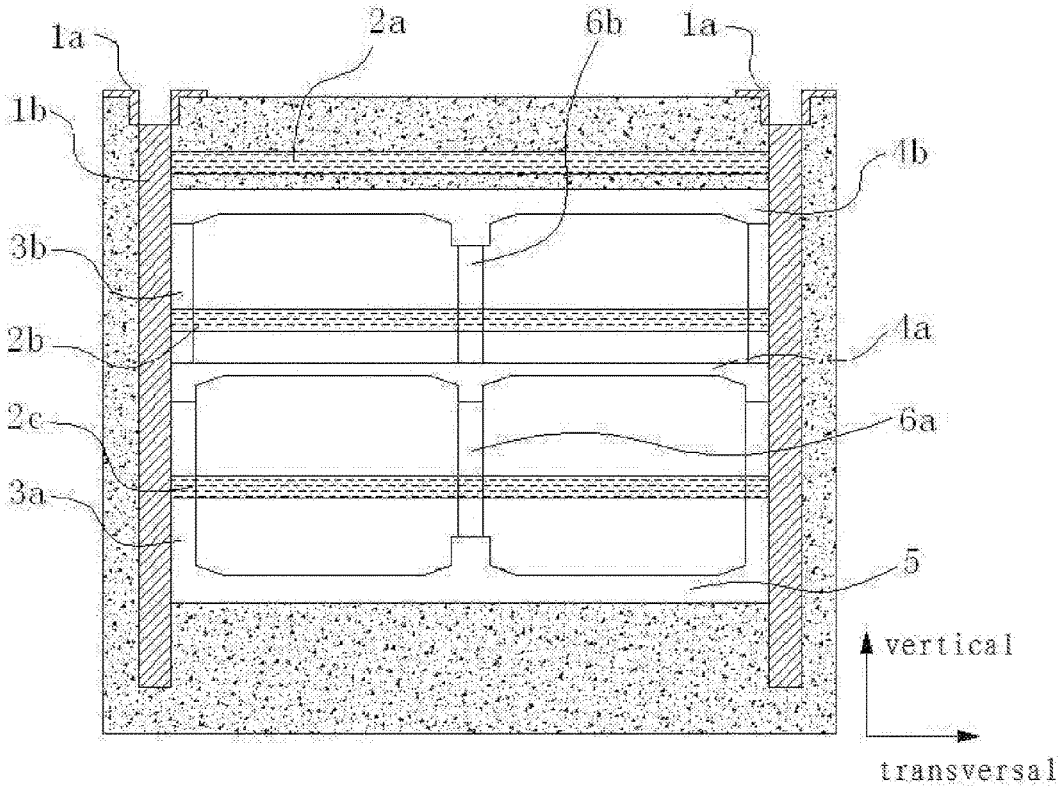
FIG. 1 shows a construction system for a subway station according to an embodiment of the present application.

What is shown in FIG. 1 is an embodiment of a construction system for a subway station, wherein the total length of the subway station is constructed to be 381.2 m, the width of the station envelope in a standard section 19 m, and the total building area 15224 $m^2$. A two-storey and two-span frame structure of an all-cut type is used, wherein the underground first storey is the storey of station hall and the underground second storey is the storey of station platform. In the embodiments, the construction system comprises constructing a guide wall 1*a*, constructing an underground continuous walls 1*b*, excavating a first layer of earth, constructing a first concrete support beam 2*a*, excavating a second layer of earth, constructing a second concrete support beam 2*b*, excavating a third layer of earth, constructing a steel support 2*c*, constructing a bottom slab 5, dismantling the steel support 2*c*, constructing a sidewall 3*a* and a steel column 6*a* of an underground second storey, constructing a floor slab 4*a* of the underground second storey, dismantling the second concrete support beam 2*b*, constructing a sidewall 3*b* and a column 6*b* of an underground first storey, constructing a floor slab 4*b* of the underground first storey, and dismantling the first concrete support beam 2*a*. An enclosure-and-protection structure of the subway station is formed after the step of constructing the steel support is complete, and a main structure of the subway station is formed after the step of dismantling the first concrete support beam is complete. Of course, the present invention is not limited to construction of an underground with two storeys of a subway station, but is applicable to an underground with three, four or even more storeys, depending on the actual construction site of a subway station.

Figure 2:
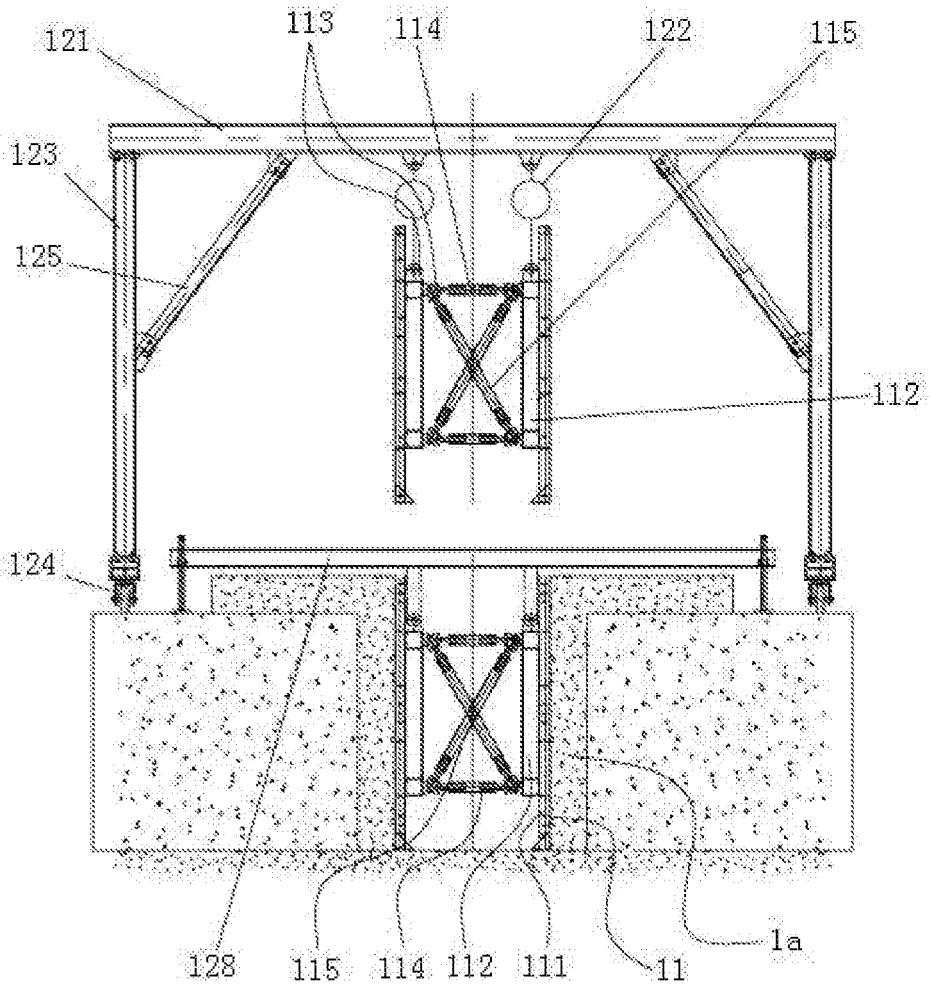
FIG. 2 shows a front view of a guide-wall steel formwork system for the construction of guide walls according an embodiment of the present application.
Figure 3:
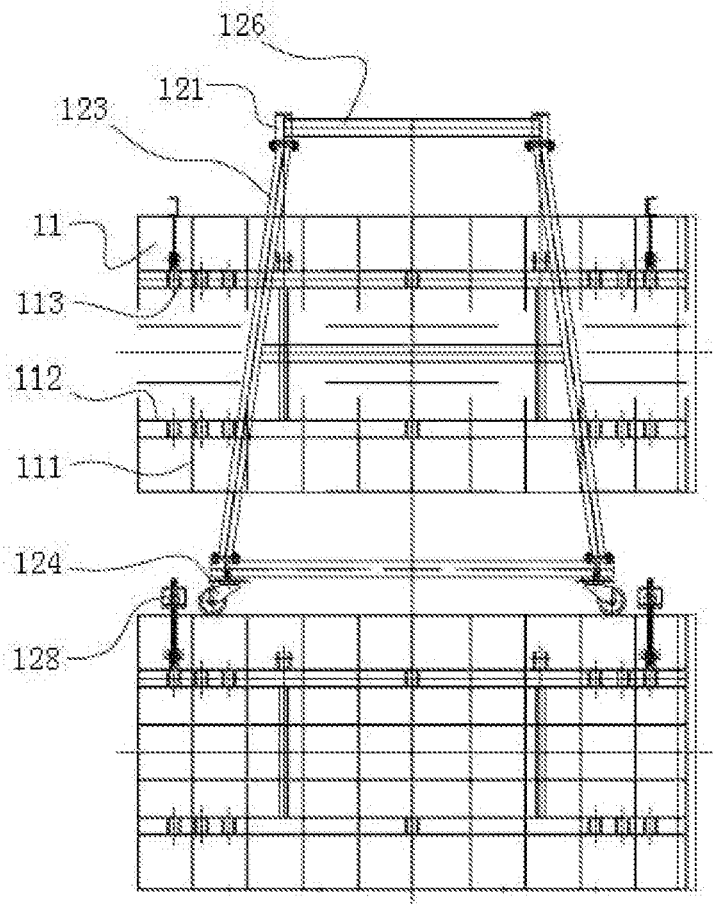
FIG. 3 is a side view of the guide-wall steel formwork system shown in FIG. 2.
Figure 4:
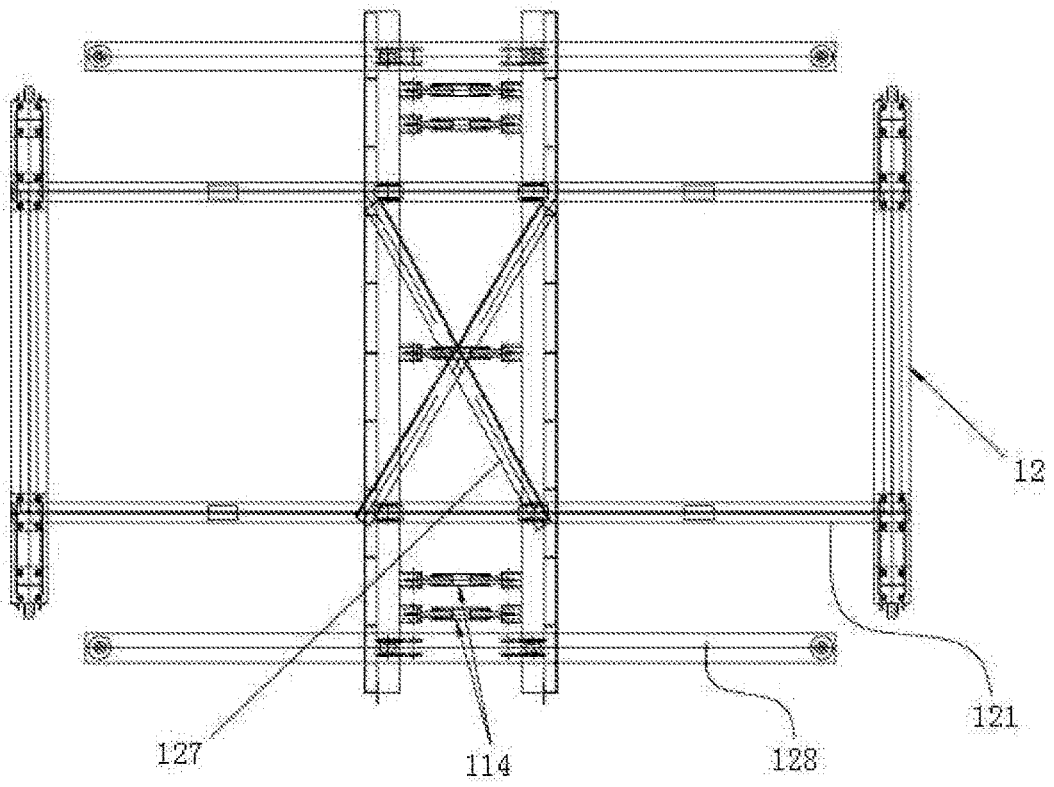
FIG. 4 is a top view of a gantry of the guide-wall steel formwork system shown in FIG. 2.

As shown in FIGS. 2-4, the construction of the guide walls 1*a* is performed by making the guide walls into "ㄱㄱ" shaped cast-in-place steel reinforced concrete structures via a guide wall steel formwork system, that is, "ㄱ" shaped steel reinforced concrete structures cast symmetrically at two sides of the foundation trench and comprising horizontal parts and vertical parts. The guide wall steel formwork system comprises a guide wall steel formwork 11 and a movable hoisting mechanism for steel formworks arranged parallel and opposite to each other, the guide wall steel formwork 11 being fixedly provided with a reinforcement rib 111 on the inner side thereof, the reinforcement rib 111 being fixedly connected with a reinforcement through beam 112, the reinforcement through beam 112 being provided with a U-shaped clamp 113. A plurality of jack screws 114, 115 arranged transversally and/or inclinedly are connected between the guide wall steel formworks 11 and provide support thereto. The jack screws 114, 115 are at both ends thereof pin-connected with the U-shaped clamp 113. The movable hoisting mechanism for steel formworks comprises a gantry 12 having a gantry cross beam, a crane 122 mounted to the underside of the gantry cross beam 121 of the gantry 12, the gantry 12 having a column 123, a lower end of the column 123 being provided with running wheels 124.

In the construction of guide walls of underground continuous walls for a long and large foundation trench, with the guide wall steel formwork system of the present invention, the grid reinforcement rib 111 and the reinforcement through beam 112 provided on the inner side of the guide wall steel formwork 11 maintain the overall rigidity and stability of the guide wall steel formwork, ensuring molding precision. Besides, the jack screw 114, 115 internally arranged transversally and inclinedly provide additional benefits, wherein the jack screw 114 arranged transversally may provide precise adjustment of the distance between the steel formworks and the guide walls, thereby ensuring casting quality, and may regulate the distance between two guide wall steel formworks via fast telescoping. The stable triangular configuration, formed by the jack screw 114 arranged transversally with the jack screw 115 arranged inclinedly, connects the formworks at two sides to form an integral body as a complete formwork, enabling fast and convenient assembly and disassembly. Consequently, labor hour is reduced, assembly and disassembly are simplified, labor cost is lowered, and the strength of the guide wall steel formwork system and therefore the precision of casting are ensured. The guide wall steel formworks can be repeatedly used in construction of guide walls for continuous walls of a same or similar specification, thereby saving material cost.

Additionally, it is preferable for the gantry 12 to be a two-folded gantry, which comprises a column 123, a gantry cross beam 121, a splayed support lever 125 fixedly connected with the column 123 and the gantry cross beam 121 respectively at two ends thereof, and an auxiliary cross beam 126 fixedly connected with the two-folded gantry, the two-folded gantry is securely connected via an intersect support assembly 127. The crane 122 at the underside of the gantry cross beam 12 may be connected with the guide wall steel formwork 11 via a U-shaped clamp, so as to move the overall formwork to the next working position, enabling fast loading and unloading and reducing the labor hours. Position alignment is performed during the movement by a positioning channel steel 128 anchored on the ground beforehand, and thus positioning is achieved without a track, enabling a fast and precise mounting. The running wheel 124 is made of steel or rubber, and has a rotation freedom of 360°, enabling an increased system flexibility.

The construction of the guide walls of continuous walls by using the aforementioned guide wall steel formwork system is performed following the steps of: step (1): leveling the ground, excavating a foundation trench and binding reinforcing steel bars at two sides of the foundation trench, step (2): after the step (1) is complete, hoisting the guide wall steel formwork system to the construction site of the guide wall, and coating the two guide wall steel formworks 11 with a release agent, step (3): after the step (2) is complete, placing the two guide wall steel formworks 11 under the movable hoisting mechanism, passing a steel cable through the U-shaped clamp 13 on a transverse rib of the grid reinforcement rib 111, connecting the steel cable to the crane 122, hoisting the guide wall steel formworks 11 using a pulley block, moving the movable hoisting mechanism hanging the guide wall steel formworks to a standard construction site of the guide wall 1*a*, and placing the guide wall steel formworks 11 into the foundation trench, step (4): after the step (3) is complete, adjusting the length of the jack screws to move the guide wall steel formwork to a predetermined distance from a corresponding inner wall of the foundation trench, locking the jack screws so as to fix the guide wall steel formworks, disengaging the steel cable, and moving the movable hoisting mechanism to continue to hoist a next set of guide wall steel formworks, step (5): after the step (4) is complete and when a second set of guide wall steel formworks is moved to a standard construction site, adjusting the position of the second set of guide wall steel formworks according to the first set of guide wall steel formworks so as to make them aligned with each other, step (6): after the step (5) is complete and when the two sets of guide wall steel formworks are aligned with each other, filling the space between the two sets of guide wall steel formworks 11, step (7): after the step (6) is complete, repeating the above steps till a preset number of guide wall steel formworks 11 have been mounted, and step (8): after the step (7) is complete, casting concrete, disassembling the guide wall steel formworks after the concrete is solidified, and turning to a next construction cycle.

Construction of the underground continuous walls 1*b* is performed by casting a wall of a concrete structure vertically downwards along the guide walls 1*a*, as is shown in FIG. 1.

Figure 5:
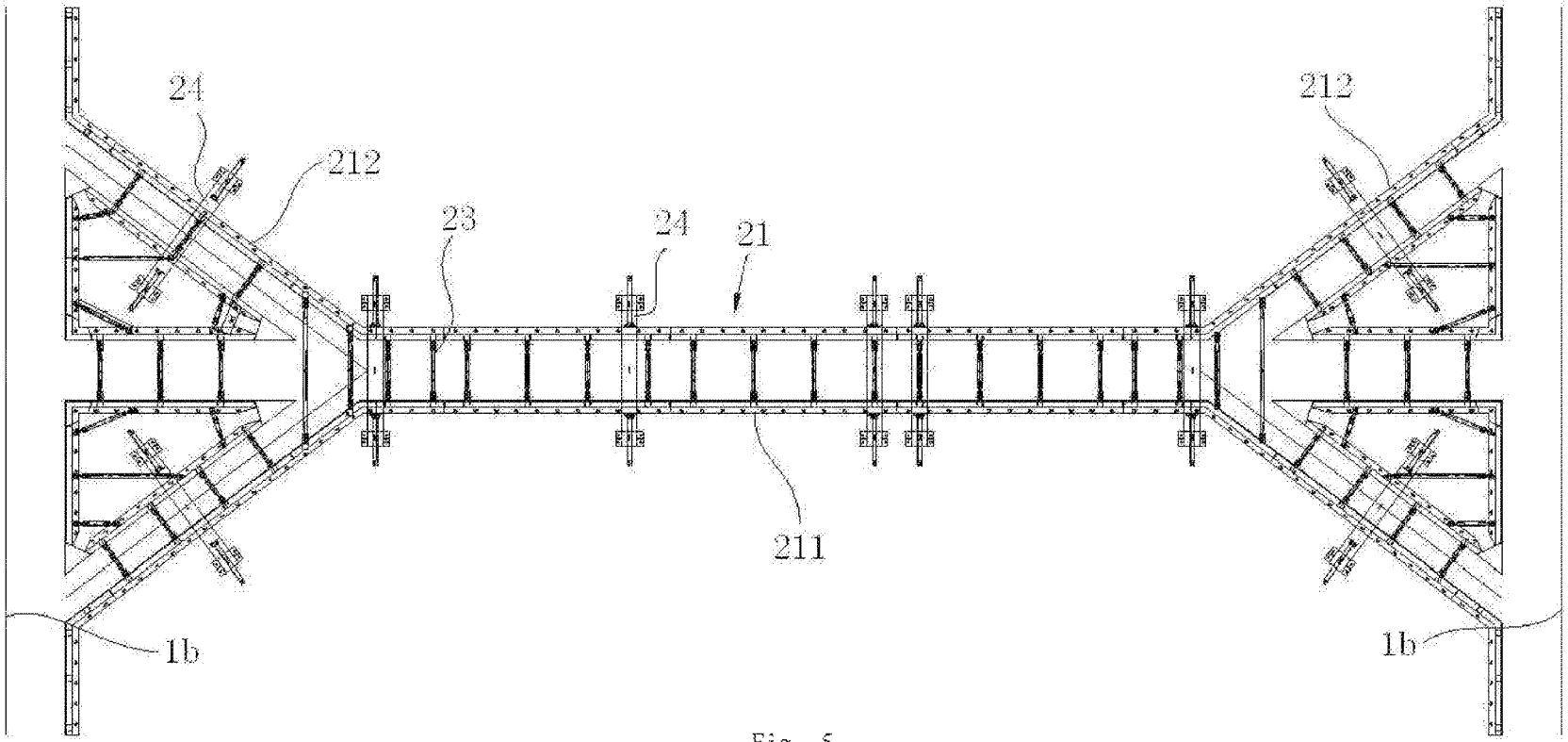
FIG. 5 shows a support-beam steel formwork system for the construction of a support beam.
Figure 6:
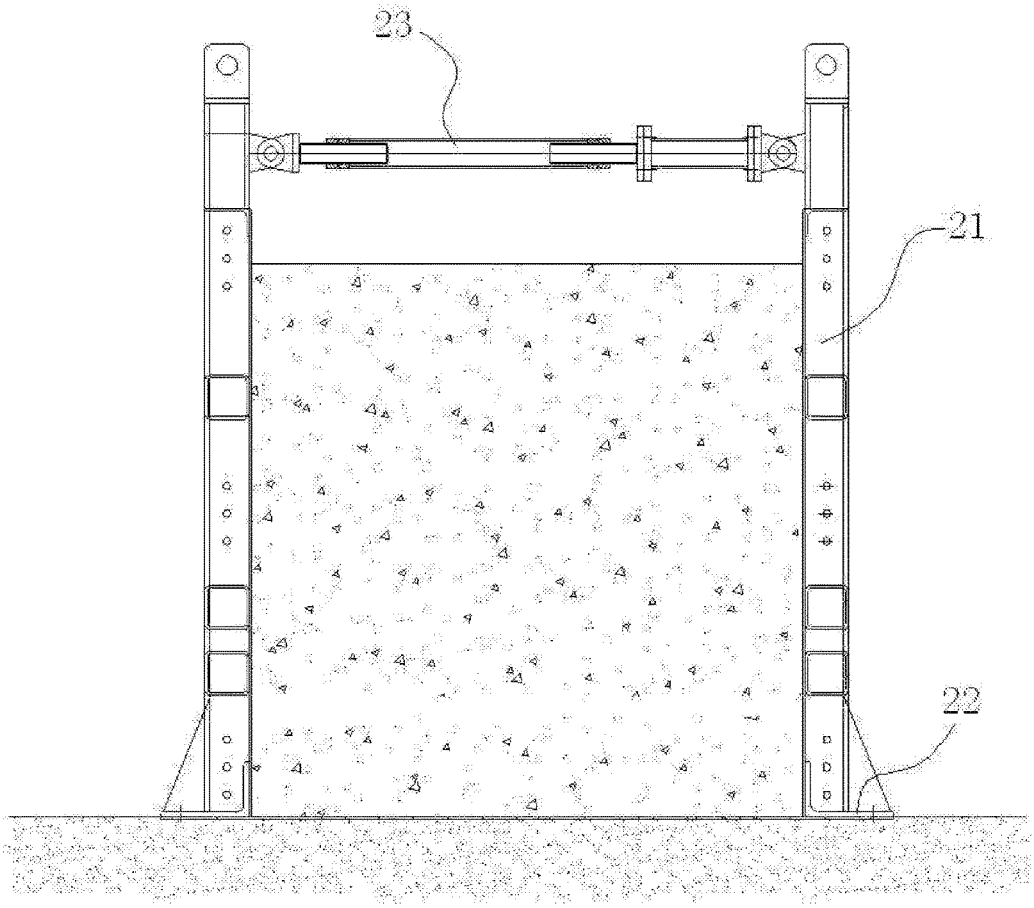
FIG. 6 shows a support-beam steel formwork of the support beam steel formwork system shown in FIG. 5.
Figure 7:
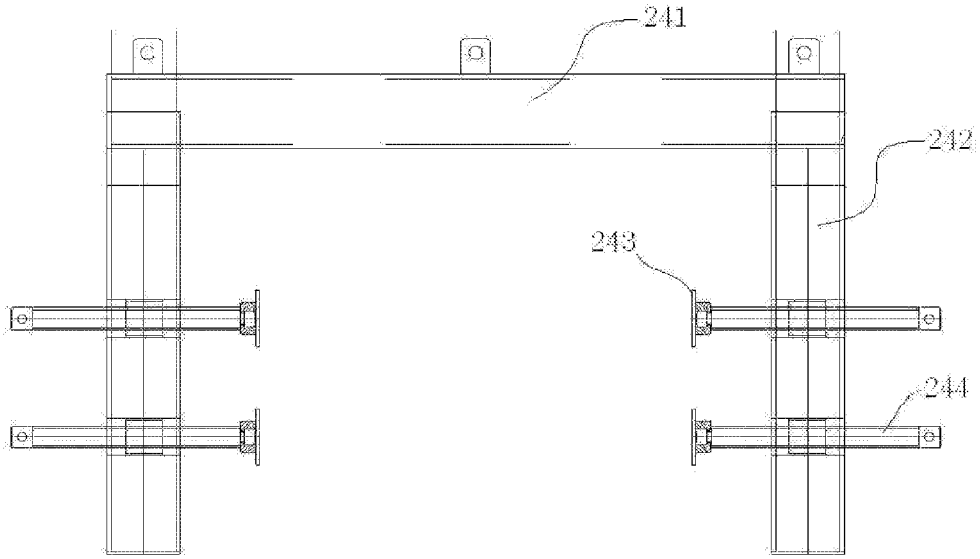
FIG. 7 shows an outer support frame of the support-beam steel formwork system shown in FIG. 5.
Figure 8:
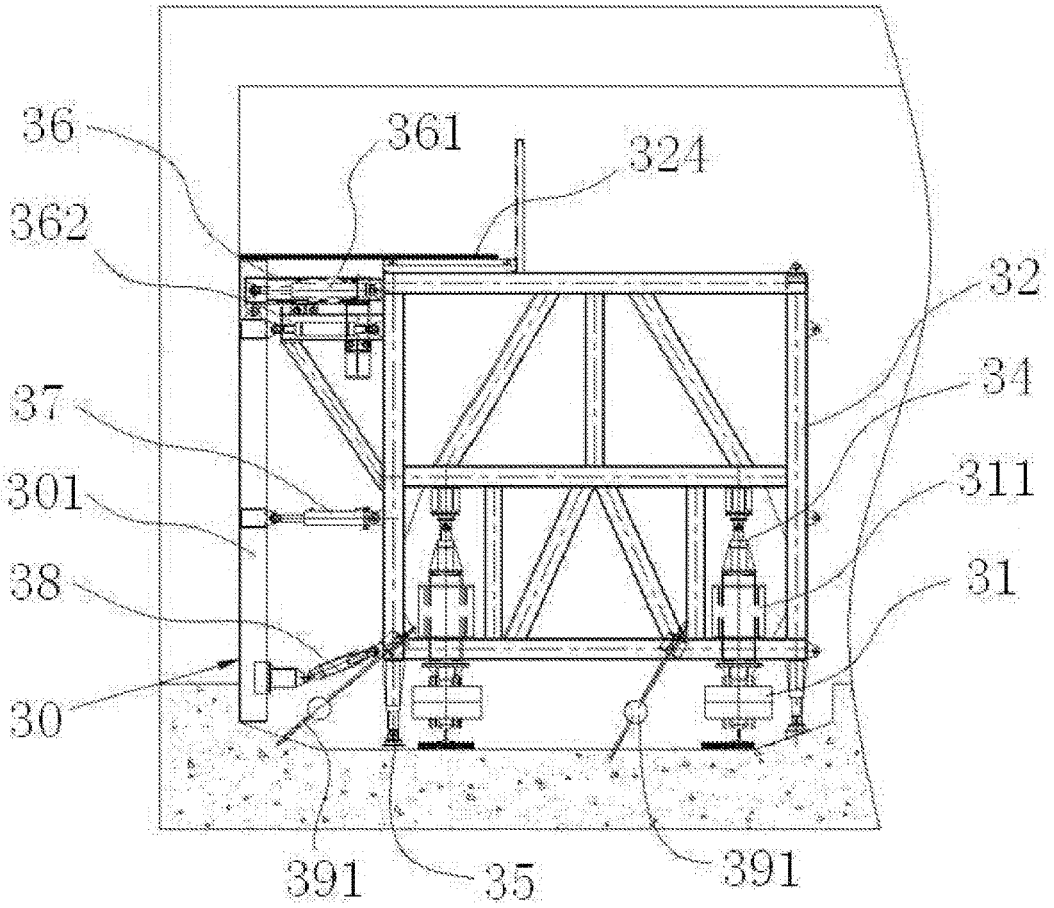
FIG. 8 shows a front view of a sidewall trolley for the construction of sidewalls according to an embodiment of the present application.

Further, as is shown in FIGS. 5-7, the construction of the support beams 2*a*, 2*b* is performed by making the support beams 2*a*, 2*b* into cast-in-place steel reinforced concrete structures with the middle part as a primary beam and with the two ends as inclined beams. Using the support beam steel formwork system, the support beams 2*a*, 2*b* are braced transversally between two sides of the underground continuous walls. The support beam steel formwork system comprises a support beam steel formwork 21 formed by formworks arranged parallel and opposite to each other, the support beam steel formwork 21 comprising a primary beam steel formwork 211 located in a middle part thereof and two bracing beam steel formworks 212 at each end thereof. Further, bracing beam steel formworks 212 of the support beam steel formwork 21 exhibit a "⋗" shape and a "⋖" shape, respectively. The support beam steel formwork 21 may be provided at the bottom thereof with a foot support 22 locked to the ground. The foot support 22 is preferably an angle steel, which may be locked to the ground via a bolt or screw. Jack screws 23 are arranged at the top of the support beam steel formworks 21 and provide support and connection between the two support beam steel formworks arranged parallel and opposite to each other. The support steel formwork 21 is provided with an outer support frame 24 which may support and abut the support beam steel formwork 21. The outer support frame 24 comprises a gantry having a gantry cross beam 241 and a steel column 242 and a support rod assembly mounted at the gantry column 242 for supporting the support beam steel formwork 21. The support rod assembly comprises a support plate 243 for abutting the support beam steel formwork and a support rod 244 for accommodating the forward and backward movements of the support plate 243. The support plate 243 is connected to an end of the support rod 244, and the support rod 244 is a screw which passes through the column and is screwed with the column 242.

In an embodiment of the present invention, the support beam steel formwork 21 of the support beam steel formwork system is formed by combining large steel plates arranged parallel and opposite to each other. The foot supports 22 arranged at the bottom of the support beam steel formwork 21, the jack screws 23 for abutting the support beam steel formwork at the top and the outer support frame 24 arranged at the outer side of the support beam steel formwork 21 constitute a firmly connected and supplementary whole, thereby effectively supporting and fixing the support beam steel formwork 21. In this way, the resultant support beam steel formwork is resistant to deformation and has an improved integrity, thereby significantly improving the quality of the cast concrete, and effectively avoiding the occurrence of structural deformation during concrete casting, mainly deformation caused by lateral torsion. Moreover, the mounting of the jack screw 23 and the outer support frame 24 is easy and convenient, which can be accomplished by mechanical hoisting, hence accelerating the assembly and disassembly of the support beam steel formwork 21 and improving construction efficiency. With conventional wooden formwork or small steel formwork, a counter rod needs to be provided between the formworks which are arranged side by side for abutting and providing support thereto. To this end, it is necessary for counter rod plastic tubes to be embedded in the steel reinforced concrete during casting of the support beam. However, the plastic tubes are to be embedded in a large quantity, and the procedure is complex, resulting in a low efficiency. Additionally, since the reserved position in the support beam steel formwork 21 for the counter rod is fixed, the counter rod often interferes in terms of space with the reinforcing steel bar in the steel reinforced concrete, leading to a low reliability. In contrast, with the outer support frame structure of the present invention, the aforementioned problems related with counter rod can be well overcome. In particular, the space interference between the counter rod and the reinforcing steel bar in the steel reinforced concrete would no longer occur, and the deformation caused by lateral torsion during casing of the support beam could be avoided. Preferably, two pairs of counter rod assembly are symmetrically provided at the columns located at the two sides of the outer support frame, providing a more secure and even support for the support beam steel formwork 21.

It is to be explained that, since the inclined support beam formwork at the two ends of the support beam steel formwork 21 has a "⋗" or "⋖" shape, the inclined support beam formworks 212 correspondingly would have some parts with smaller area, especially in the portion which meets with the middle primary beam. With all-steel large formworks, piecing needs to be performed less times, mounting is convenient to carry out, and it requires less technical skill for the workers as well as less intensive labor, compared with conventional wooden formworks. For the inclined support steel formwork 212 at the end of the support beam steel formwork system having a comparatively complex structure due to the "⋗" or "⋖" shape, using conventional wooden formworks would mean complex force distributions and easy occurrence of formwork shifting, while using large steel formworks with better integrity would well avoid similar problems.

The construction of the support beam by using the aforementioned support beam steel formwork is performed following the steps of: step (1): excavating the earth to a predetermined depth, leveling the ground, providing a base pad for the support beam to be constructed, and binding reinforcing steel bars, step (2): after the step (1) is complete, hoisting the support beam steel formwork system to a construction site of the support beam 2*a*, 2*b*, and coating the steel plates with a release agent, step (3): after the step (2) is complete, hoisting the steel plates to a standard construction site of support beam, hoisting and piecing together the steel plates simultaneously, wherein the hoisting and piecing together of the steel plates are started from the construction of the inclined support beam steel formwork, step (4): after the step (3) is complete, mounting the jack screw 23, which is in a loosened state after the mounting, and then making adjustment from the two ends of the support beam steel formwork 21 towards the middle part thereof, till the adjustment is made properly, step (5): after the step (4) is complete, placing the outer support frame 24 on the support beam steel formwork 21, pressing the gantry cross beam 241 just on the support beam steel formwork, making the column 242 of the gantry of the outer support frame in contact with the ground, and then adjusting the support rod 244 to make the support plate 243 abut the support beam steel formwork 21 and thus the latter is prevented from moving, step (6): after the step (5) is complete, tightening the jack screw 23 to finish the mounting of the support beam steel formwork, and step (7): after the step (6) is complete, casting concrete, and disassembling the support beam steel formwork.

With reference to FIGS. 1 and 8-11, the construction of the sidewalls 3*a*, 3*b* is performed by using a sidewall trolley provided with a sidewall trolley moving and fixing system and a sidewall steel formwork connecting and positioning system to cast a layer of steel reinforced concrete structure on the inner surface of the two lateral walls of the enclosure structure. The sidewall trolley is a sidewall trolley unit or a combination of a plurality of sidewall trolley units pieced together longitudinally. In an embodiment, the sidewall trolley is designed to be 12 m in length, and can be separated into two sidewall trolleys of 6 m long in order to meet certain construction conditions. Description is made hereafter with reference to a sidewall trolley embodiment which is pieced together with a length of 12 m.

The sidewall trolley moving and fixing system of the aforementioned sidewall trolley comprises a base 31 provided with a steel column 311, a beam-frame assembly 32 movably connected to the steel column 311 and a running system 33 mounted below the base 31. Specifically, the aforementioned running system 33 comprises a moving wheel 331 mounted below the steel column 311, a running track 332 cooperative with the moving wheel 331 and a drive means 333 for providing running power. With this running system 33, the beam-frame assembly 32 can be brought into a smooth longitudinal movement, thereby adjusting the longitudinal position of the sidewall steel formwork 30 during its positioning. Meanwhile, the track design ensures a stable longitudinal running and a high bearing capacity. The two longitudinal sides of the middle part of the beam-frame assembly 32 are provided with lintel ends 321, and below the lintel ends 321 are provided a plurality of screw jacks 34 for vertical movement of the beam-frame assembly 32. The screw jacks 34 are fixed on a steel column 311 of the base 31. In an embodiment, there are preferably six screw jacks 34. When the trolley is moved in place, the beam-frame assembly 32 is moved vertically by the screw jacks 34, so as to adjust the vertical position of the sidewall steel formwork 30 during its positioning. Thereafter, the beam-frame assembly 32 is supported on the track and the ground via a plurality of bearing jacks 35 provided at the bottom of the beam-frame assembly 32, thereby reducing the force asserted on the running system 33 and improving the bearing capacity and stability of the trolley system, thus enabling a smooth anchoring of the trolley on site. In an embodiment, the number of the bearing jacks 35 is preferably six at each side, and twelve for both sides.

Figure 9:
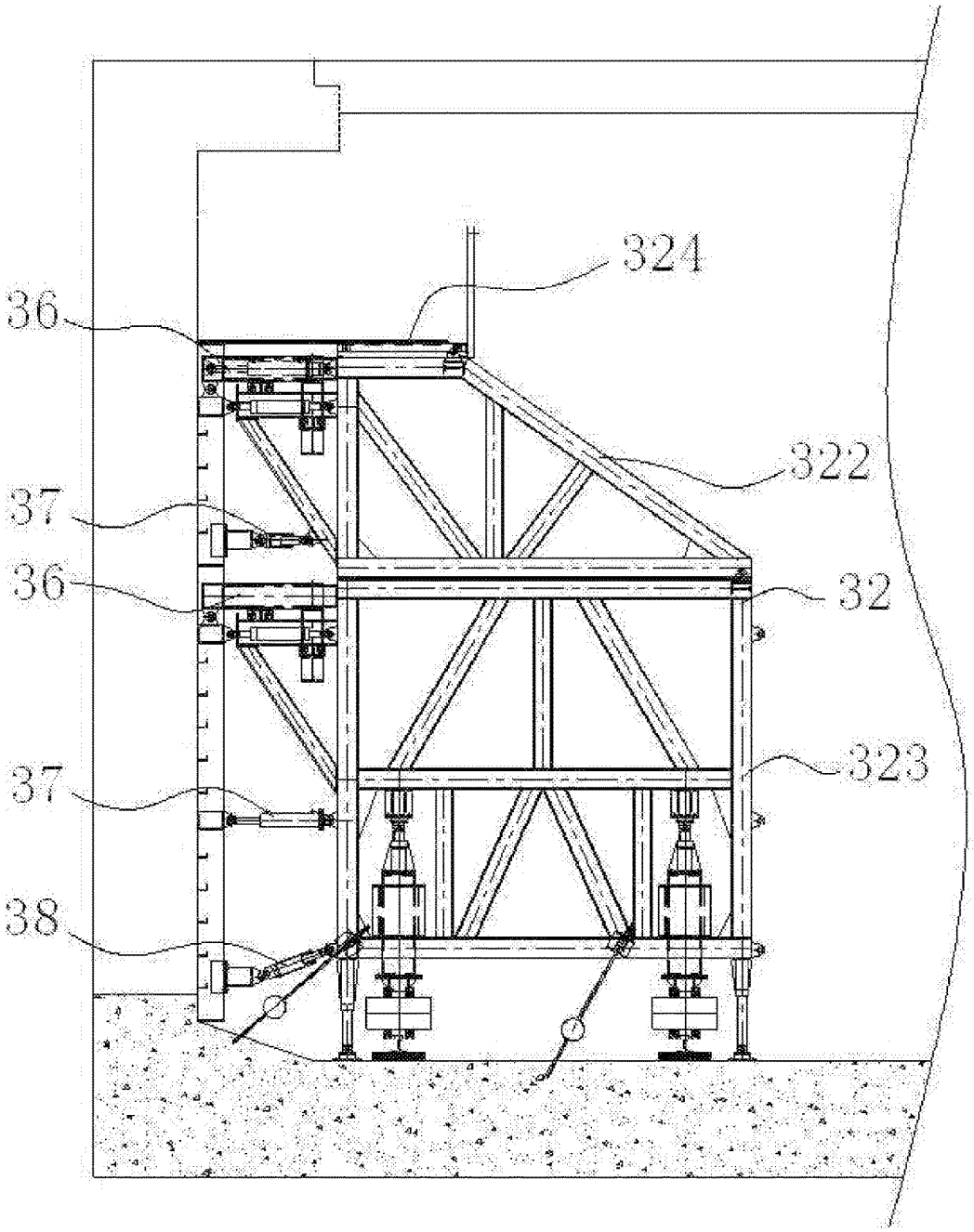
FIG. 9 shows a front view of a sidewall trolley for the construction of sidewalls according to another embodiment of the present application, wherein a beam-frame assembly comprises an upper beam-frame assembly and a lower beam-frame assembly, thus having an increased height.
Figure 10:
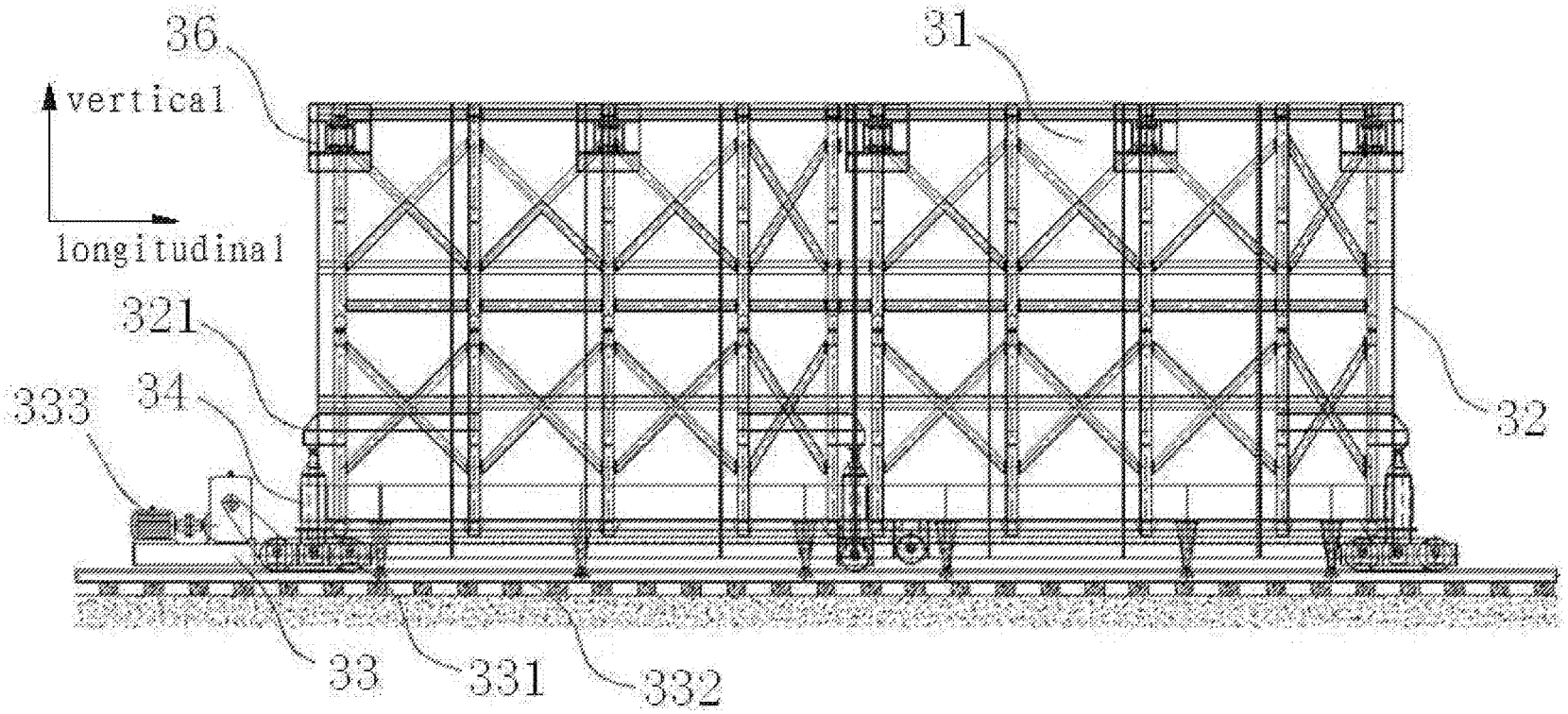
FIG. 10 is a side view of the sidewall trolley shown in FIG. 9.
Figure 11:
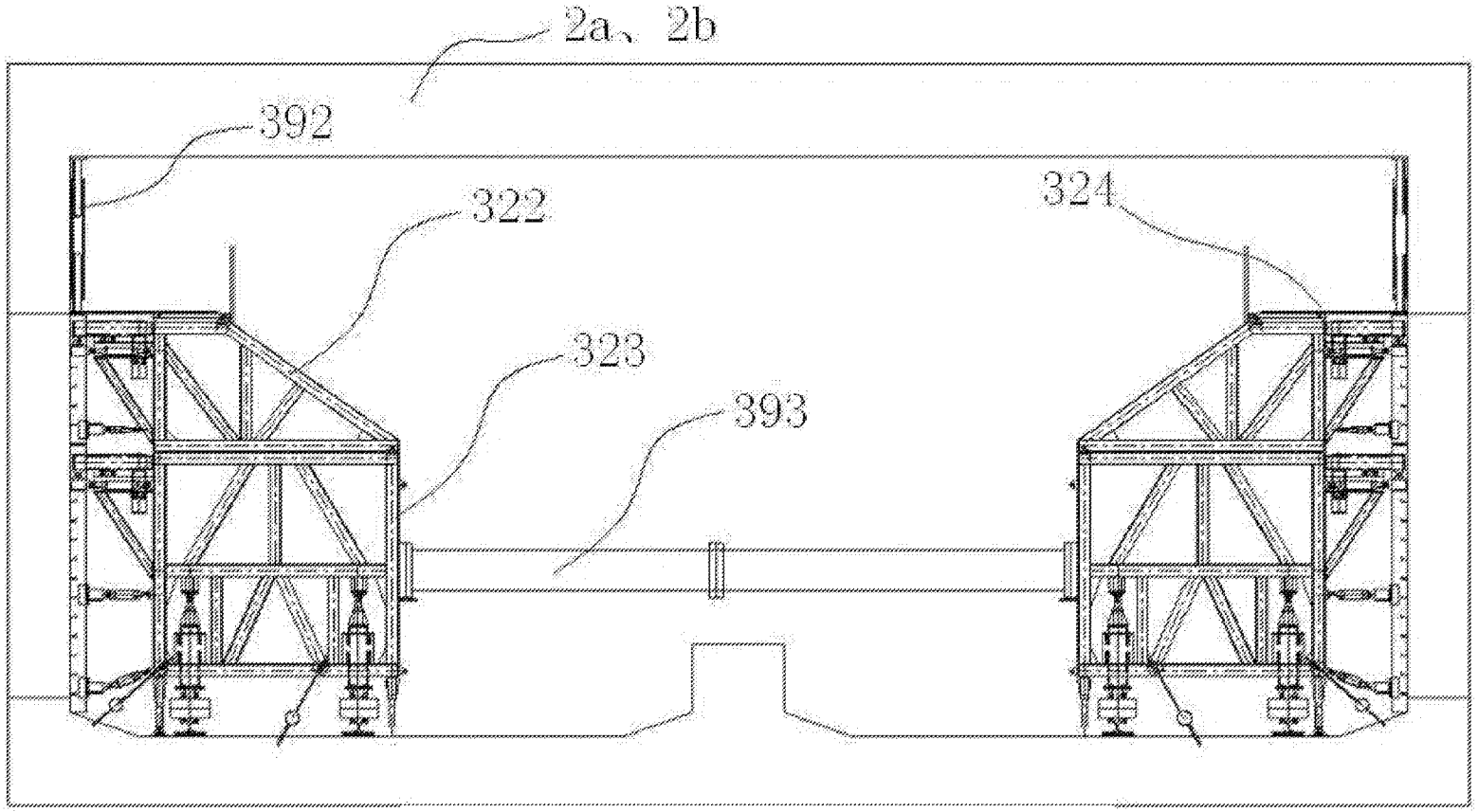
FIG. 11 shows a front view of two sidewall trolleys for simultaneously constructing two sidewalls according to an embodiment of the present application.

In the embodiment shown in FIG. 9, the beam-frame assembly 32 is formed in an overlapped manner by an upper beam-frame assembly 322 and a lower beam-frame assembly 323, the upper and lower beam-frame assembly 322, 323 being fixedly connected with each other via bolts. In an embodiment, taking into account the different heights of the sidewalls 3*b*, 3*a* of the underground first and second storeys, the height of the sidewall steel formwork 30 is designed to be 3.5 m+1.7 m. Casting of the sidewall 3*a* of the underground second storey is performed using a steel formwork trolley of 3.5 m+1.7 m, that is, a trolley comprising the upper beam-frame assembly 322 and the lower beam-frame assembly 323, whereas casting of the sidewall 3*b* of the underground first storey is performed using a steel formwork trolley of 3.5 m, that is a trolley without the upper beam-frame assembly 322. In this way, it is possible to adjust the height of the trolley in order to meet the construction requirements for different heights depending on the construction conditions of sidewalls, thus promoting adaptability of the trolley. Additionally, a construction platform 324 is built at the top of the upper beam-frame assembly 32 to facilitate the construction.

The sidewall steel formwork connecting and positioning systems of the aforementioned sidewall trolley comprises a sidewall steel formwork 30 formed by a plurality of steel plates fixed on a formwork frame 301 which are pieced together, and a plurality of telescopic cantilevers 36 mounted on the upper part of the beam-frame assembly at a side facing the sidewall under construction. In an embodiment, the number of the telescopic cantilevers 36 is six. Specifically, the telescopic cantilevers 36 are internally provided with hydraulic jacks 361, and are placed on slidable seats 362, whereby the sidewall steel formwork 30 may translate smoothly. The sidewall steel formwork 30 is provided at a side facing the trolley with longitudinal and vertical reinforcement ribs, which may enhance the structural strength of the sidewall steel formwork, making the sidewalls more flat and thus improving construction quality. An upper longitudinal beam of the formwork frame 301 is pin-connected with a free end of the telescopic cantilever 36, and a plurality of hydraulic jacks 37 are provided between a middle longitudinal beam of the formwork frame 301 and the beam-frame assembly 32. In an embodiment, the number of the hydraulic jacks 37 is preferably five. In this way, the sidewall steel formwork 30 can be moved by telescopic movement of the telescopic cantilevers 36 and the hydraulic jacks 37, whereby longitudinal position of the sidewall steel formwork 30 can be adjusted during its positioning, and automatic formwork assembly and disassembly can be achieved. Meanwhile, the cantilevered design of the sidewall steel formwork 30 effectively alleviate the problem of too high a burden resulted on connecting parts of the device due to the fact that the sidewall steel formwork 30 itself is too heavy, thereby increasing stability of structures of the system and shortening construction duration. Moreover, by the several pairs of lateral jack screws 38 arranged longitudinally which are connected between the sidewall steel formwork 30 and the beam-frame assembly 32, the sidewall steel formwork 30 is ensured to be fixed to the beam-frame assembly 32. In an embodiment, at least in the upper, middle and lower parts between the sidewall steel formwork 30 and the beam-frame assembly 32 respectively, there is provided one longitudinal line of jack screws 38. There are six jack screws 38 in each longitudinal line, except for the lines in which the telescopic cantilever and the hydraulic jacks 37 are arranged.

The construction of the sidewalls by using the aforementioned sidewall trolley is performed following the steps of: (1) laying a miming track 322 on the ground: according to the predetermined distance between the running track 332 and the sidewall under construction, laying the running track while cleaning the field; the miming track 332 of the trolley is a steel track with a density of 38 kg/m and two parallel I-steels are laid transversally under the steel track. The I-steels are separated with each other with a distance of 50 cm, and the I-steel is connected with the pre-buried reinforcing steel bar in the bottom plate via welding so as to avoid the occurrence of sliding during construction of cast concrete. Deviation of the distance between steel tracks is within 5 mm, and the tracks have to be parallel with boundary lines of the sidewalls. Calibration is carried out by a measuring instrument after the tracks are laid, and the sidewall trolley is placed on the tracks and space for assembly of parts of the device is reserved, (2) coating the sidewall steel formwork 30 with a release agent, so as to reduce surface adhesion of the steel formwork during releasing, (3) placing a counterweight, and moving the sidewall trolley in place: specifically, the high weight of the sidewall steel formwork 30 itself results in unbalanced force distribution on the two lateral sides of the sidewall trolley and therefore possibility of occurrence of tilting, which entails a counterweight to be placed on the opposite side of the sidewall trolley to the sidewall steel formwork 30 so that the sidewall trolley would be brought into a balanced condition, thus facilitating the movement of the sidewall trolley, (4) adjusting the screw jack 34, operating the handle of a respective reversing valve so as to allow the piston rod of the screw jack 34 to extend, elevating the top of the trolley to be at a designed working height, and aligning a lower edge of the sidewall steel formworks with a positioning line, (5) repeatedly adjusting the telescopic cantilever 36 and the hydraulic jacks 37 to position the sidewall steel formwork in place; in an embodiment, the positioning of the sidewall steel formwork 30 involves four control lines, a control line one to align the inner boundary line of the lower edge of the sidewall steel formwork to the positioning line, control lines two and three for verticality calibration of the two sides of the sidewall steel formwork by using an overhang, and a control line four for flatness calibration of the upper edge of the sidewall steel formwork by using a pulling line method; meanwhile, a thickness control rod for a sidewall concrete protection layer is additionally provided at the upper edge of the sidewall steel formwork, (6) adjusting the aforementioned bearing jacks 35 to fix the sidewall trolley, and ensuring that the bearing jacks 35 are completely pressed against the beam-frame assembly and would not loose, (7) mounting the aforementioned lateral jack screw 38 to fix the sidewall steel formwork 30, (8) mounting a plurality of anchor cables 391 between a pre-buried ground anchor and the sidewall trolley, and tensioning the anchor cables towards the sidewall that is under construction; loads supported and transferred over the concrete during casting thereof are mainly those in horizontal directions, avoiding occurrence of lateral sliding of the sidewall trolley and therefore making the sidewall trolley more robust. In determining the number of the ground anchors 391, analysis should be made with respect to force distribution on the bottom plate cast initially, so as to ensure that the ground anchors are able to withstand construction loads, (9) mounting a plurality of anti-floating jack screws 392, and abutting one end of each of the anti-floating jack screws 392 to a top of the sidewall steel formwork 30 and the other to a bottom of a support beam 2*a*, 2*b* of the foundation pit; the jack screws mainly support and transfer vertical loads from the sidewall steel formwork 30, so that an upward floating of the sidewall steel formwork 30 during casting of the concrete is avoided. In an embodiment, the number of the anti-floating jack screws 392 is necessarily at least four, (10) mounting high ribbed formworks and water-stop steel plates at two longitudinal sides of the sidewall steel formwork, and (11) casting a concrete, disassembling the formworks after the concrete is solidified and turning to a next construction cycle.

Further, two lines of sidewall trolleys are used simultaneously for sidewall concrete construction at two sides, the two lines of sidewall trolleys being connected by a plurality of bracing tubes 393, wherein a step as follows is further comprised between step (9) and step (10): mounting the plurality of bracing tubes 393 so that they are connected between the parallel two lines of sidewall trolleys. In the present invention, two sidewall trolleys are connected to form an integral body via a bracing tube 393, thereby construction of the two sidewall trolleys and the transverse support thereof can be performed simultaneously. The combined usage of components like bearing jacks 35, lateral jack screws 38, ground anchors 391 and anti-floating jack screws 392 enables support and transfer of loads, and further improves construction efficiency, integral stability and construction quality. In an embodiment, based on the fact that the length of the sidewall trolley is 12 m, three bracing tubes 393 are provided.

Comparisons in different aspects between construction method of sidewall concrete using sidewall trolley of the present invention and conventional construction method of building brackets of steel tubes and piecing formworks are listed as follows:

(1) Material Cost

Conventional construction: the wooden formworks are all construction wastes after construction, and a large number of steel tube brackets need to be used;

Construction of the present invention: only a set of steel formwork sidewall trolley is needed without using any wooden formworks and steel tube brackets. After construction, the steel formwork sidewall trolley can be applied to another construction project after service and maintenance.

(2) Efficiency

Time needed for procedures of construction of two sidewalls with a length of 12 m is:

| Conventional construction | | Construction of the present invention | |
|---|---|---|---|
| mounting of waterproof coil | 4 hours with 4 workers | mounting of waterproof coil | 4 hours with 4 workers |
| binding of reinforcing steel bars | 8 hours with 8 workers | binding of reinforcing steel bars | 8 hours with 8 workers |
| mounting of brackets | 16 hours with 16 workers | mounting of trolleys | 4 hours with 10 workers |
| mounting of formworks | 8 hours with 15 workers | | |
| hy-rib mesh casting | 8 hours with 4 workers | hy-rib mesh casting | 8 hours with 4 workers |
| | 5 hours with 13 workers | | 5 hours with 13 workers |
| disassembling of formworks | 4 hours with 6 workers | | |
| disassembling of brackets | 4 hours with 10 workers | disassembling of trolleys | 4 hours with 8 workers |
| total | 376 hours in total | total | 40 hours in total |
| | 64 hours in total | | |
| | 617 hours | | 249 hours |

Through a simplification to conventional procedures, the procedures of the present application reduces the time needed for construction of two sidewalls with a length of 12 m from 617 hours of conventional procedures to 249 hours, with an increase in efficiency of 148%. Therefore, it can be seen that during construction of sidewall concrete using sidewall trolley of the present invention, tracks and trolleys are used instead of brackets of steel tubes and jackings, and large steel formworks are used instead of formworks which need to be pieced together one by one, whereby there is no need to build brackets of steel tubes and to piece formworks together, which significantly simplifies construction procedures, improves speed and reliability of the mounting of formworks, increases construction efficiency and reduces labor intensity. In this way, much less labor and materials like wood and steel tubes are needed, thus lowering construction cost.

With reference to FIG. 1, and 12-16, construction of floor slabs 4*a*, 4*b* is performed by casting the part of the enclosure structure between the two lateral walls into one or more interlayers of reinforcing steel bar reinforced concrete structures using a floor slab trolley provided with a floor slab trolley moving and fixing system and a floor slab steel formwork connecting and positioning system. The floor slab trolley is a floor slab trolley unit or a combination of a plurality of floor slab trolley units pieced together. In an embodiment, the floor slab trolley is designed to be 21 m in length, and can be separated into two floor slab trolleys of 10.5 m long in order to adapt to certain construction conditions. Description is made hereafter with reference to sidewall trolley embodiments with a length of 21 m which is pieced together.

The floor slab trolley moving and fixing system for the aforementioned floor slab trolley comprises a base 41 provided with a steel column 411, a beam-frame assembly 42 movably connected to the steel column 411, and a running system 43 mounted below the base 41. Specifically, the beam-frame assembly 42 further comprises an upper frame 421 and a lower longitudinal beam 422. The running system 43 further comprises a running wheel 431 mounted below the steel column 411, a running track 432 cooperative with the running wheel and a driving means 433 for providing running power. The two longitudinal sides of the middle part of the upper frame 421 is provided with protrusions 423, and below the protrusions 423 are provided a plurality of first hydraulic jacks 441 for vertical movement of the beam-frame assembly 42, the first hydraulic jacks 441 being fixed on the steel column 411 of the base 41. In an embodiment, the number of the first hydraulic jacks 441 is preferably six. When the trolley is moved in place, the beam-frame assembly 42 is jacked up and detached with the track via a plurality of bearing jacks 45 provided at the bottom of the lower longitudinal beam 422, thus the trolley can be stably fixed in place. In an embodiment, there are ten bearing jacks 45 on each side and twenty in total for both sides. The beam-frame assembly 42 is moved in a vertical direction via the first hydraulic jacks 441, whereby adjusting of vertical position of the floor slab steel formwork 40 during its positioning can be controlled. The running system 43 achieves a stable longitudinal movement of the beam-frame assembly 42, whereby adjusting of longitudinal position of the floor slab steel formwork 40 during its positioning can be controlled. Preferably, the upper and middle sections of the upper frame 421 are overlappable frames 424, so as to accommodating different storey heights, promoting adaptability of the trolley. In an embodiment, taking into account the different heights of the underground first and second storeys, the height of the floor slab trolley is designed to be 4.75 m+1.54 m. Casting of the middle storey floor slab 4*a* of the underground second storey is performed using an upper frame of 4.75 m+1.54 m, whereas casting of the top storey floor slab 4*b* of the underground first storey is performed using an upper frame of 4.75 m.

The floor slab steel formwork connecting and positioning system of the aforementioned floor slab trolley comprises a floor slab steel formwork 40 formed by a plurality of steel plates pieced together and fixed on a formwork frame, a plurality of roller support 402 mounted on a back longitudinal beam 401 of the floor slab steel formwork 40 (wherein each line of the longitudinal beams 401 are provided with ten roller supports 402, and twenty roller supports are provided in total for the two lines of longitudinal beams 401), a plurality of transverse tracks (not shown in figures, cooperative with corresponding roller support 402, ten in total) provided on the top of the beam-frame assembly 42 and movably connected with the roller support 402, and a plurality of second hydraulic jacks 442 (six in total) mounted on the top of the beam-frame assembly 42 for a transverse movement of the floor slab steel formwork 40, free ends of the second hydraulic jacks 442 being hinged with the back longitudinal beam 401 of the floor slab steel formwork 40. It can be seen that, for the floor slab steel formwork 40, the roller support 402 is supported on the track at the top of the beam-frame assembly 42, and the transversal horizontal movement of the floor slab steel formwork 40 relative to the trolley is achieved by the second hydraulic jacks 442, whereby adjusting of transversal position of the floor slab steel formwork 40 during its positioning can be well controlled. Meanwhile, the track connection effectively ensures that floor slab steel formwork 40 is located on the same level on one hand, and improves bearing capacity of the device on the other hand.

Figure 12:
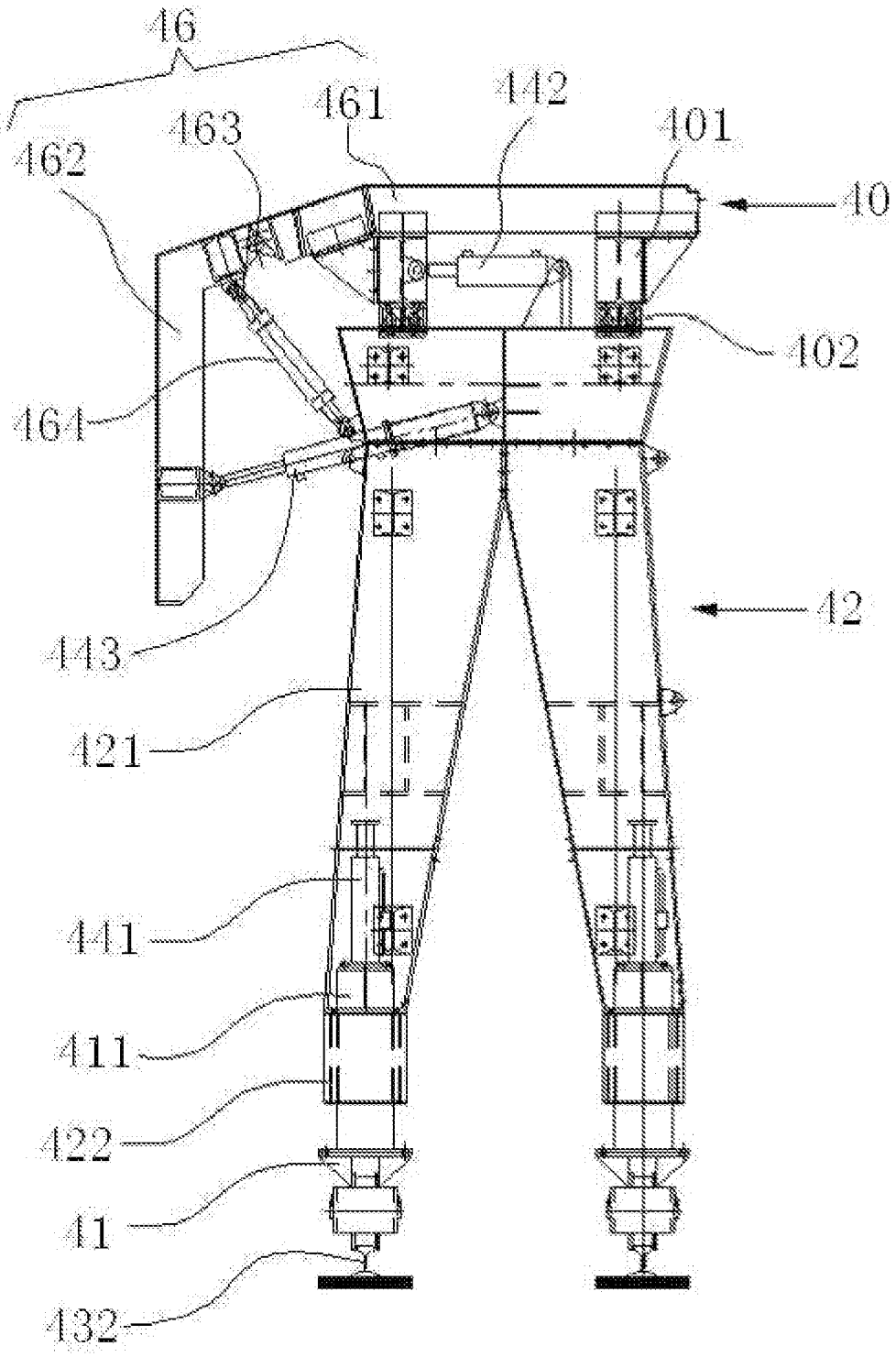
FIG. 12 shows a front view of a floor-slab trolley for the construction of floor slabs according to an embodiment of the present application, wherein the floor-slab trolley is provided with a lateral formwork.
Figure 13:
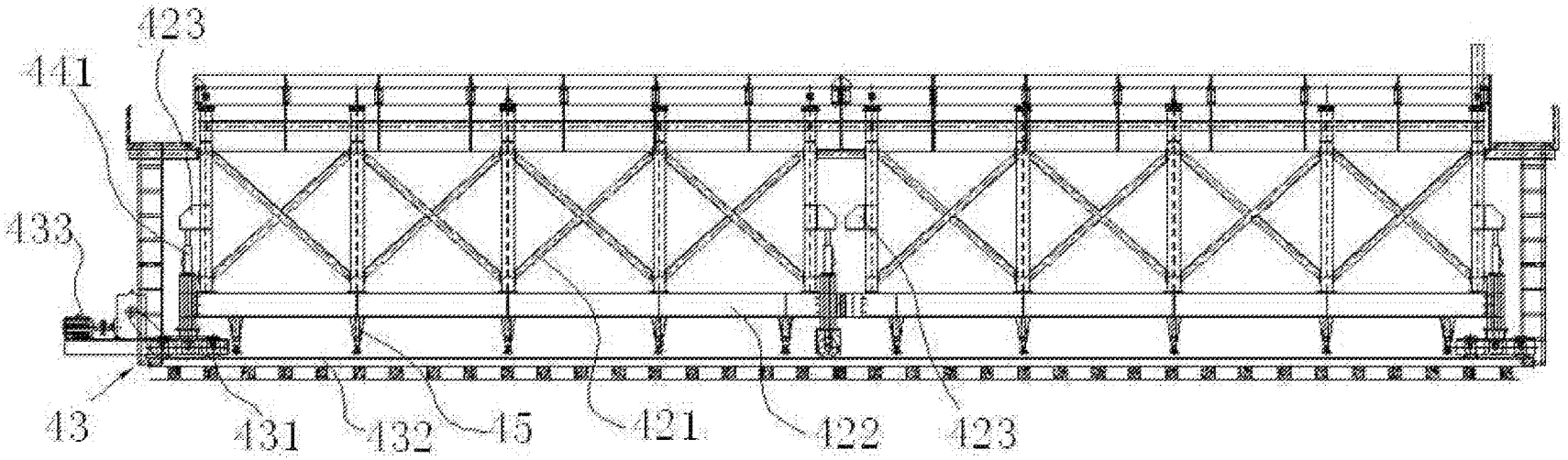
FIG. 13 is a side view of the floor-slab trolley shown in FIG. 12.
Figure 14:
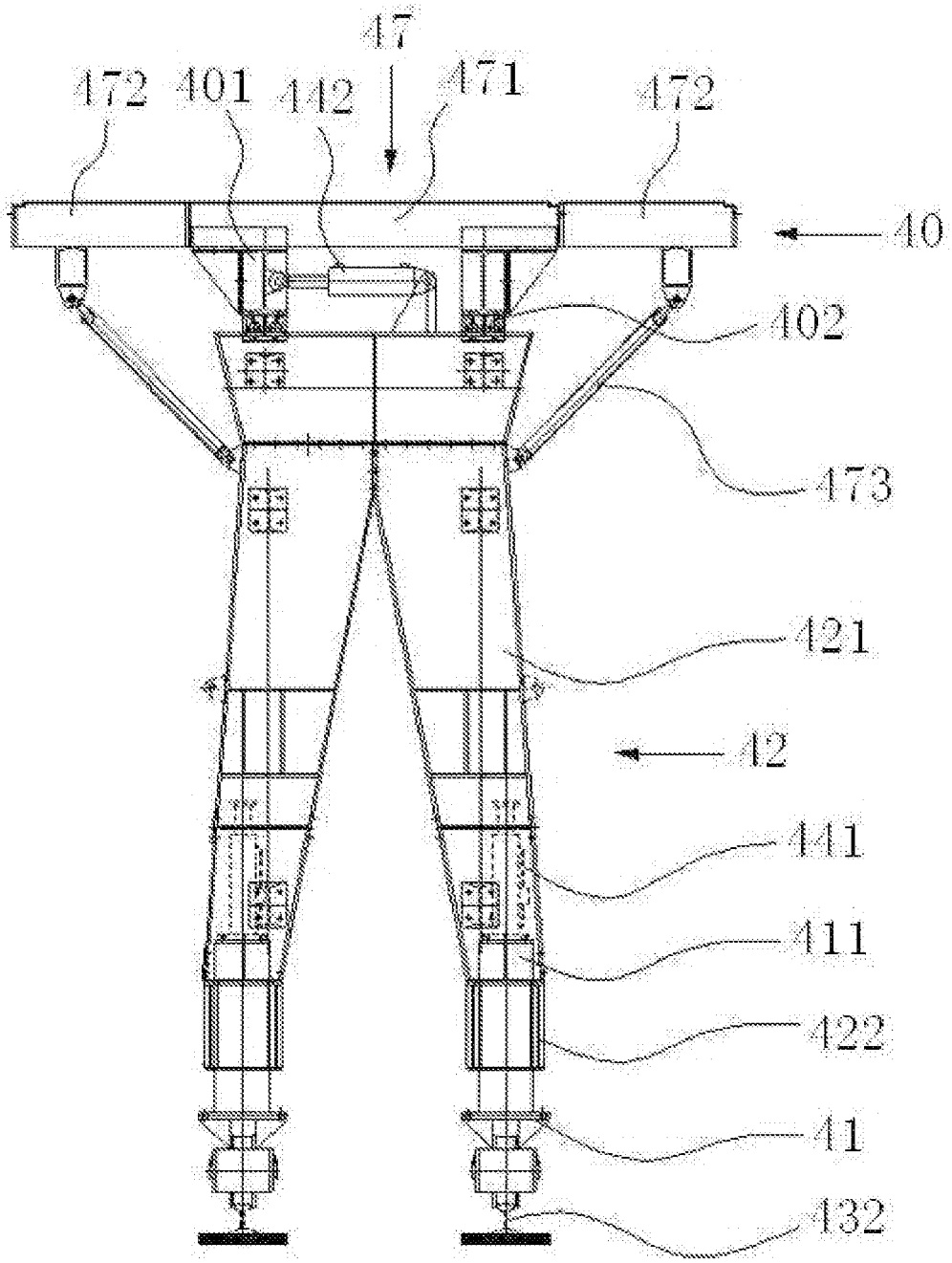
FIG. 14 shows a front view of a floor-slab trolley for the construction of floor slabs according to an embodiment of the present application, wherein the floor-slab trolley is provided with a middle formwork.
Figure 15:
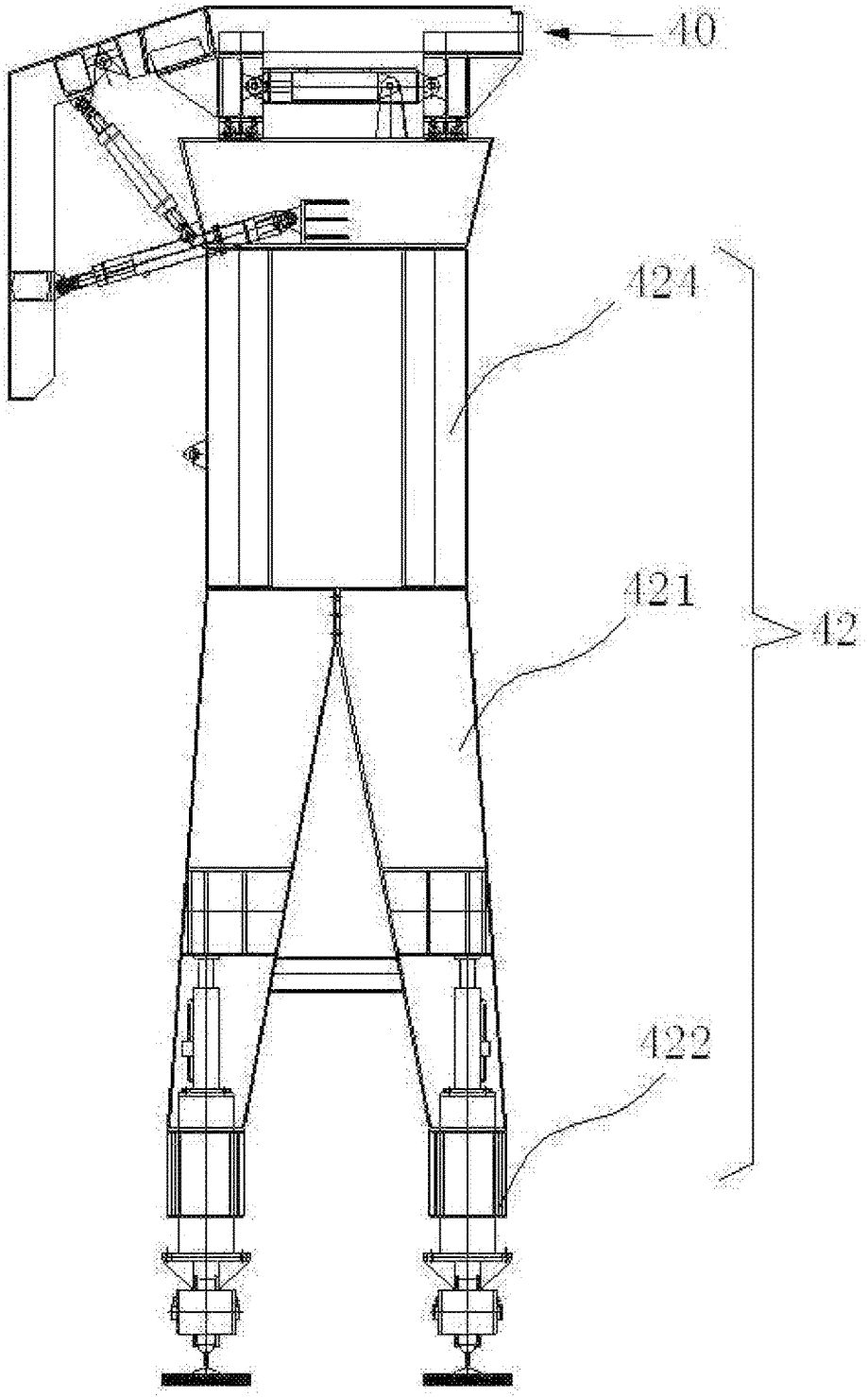
FIG. 15 is a front view of a floor-slab trolley having an overlappable frame.
Figure 16:
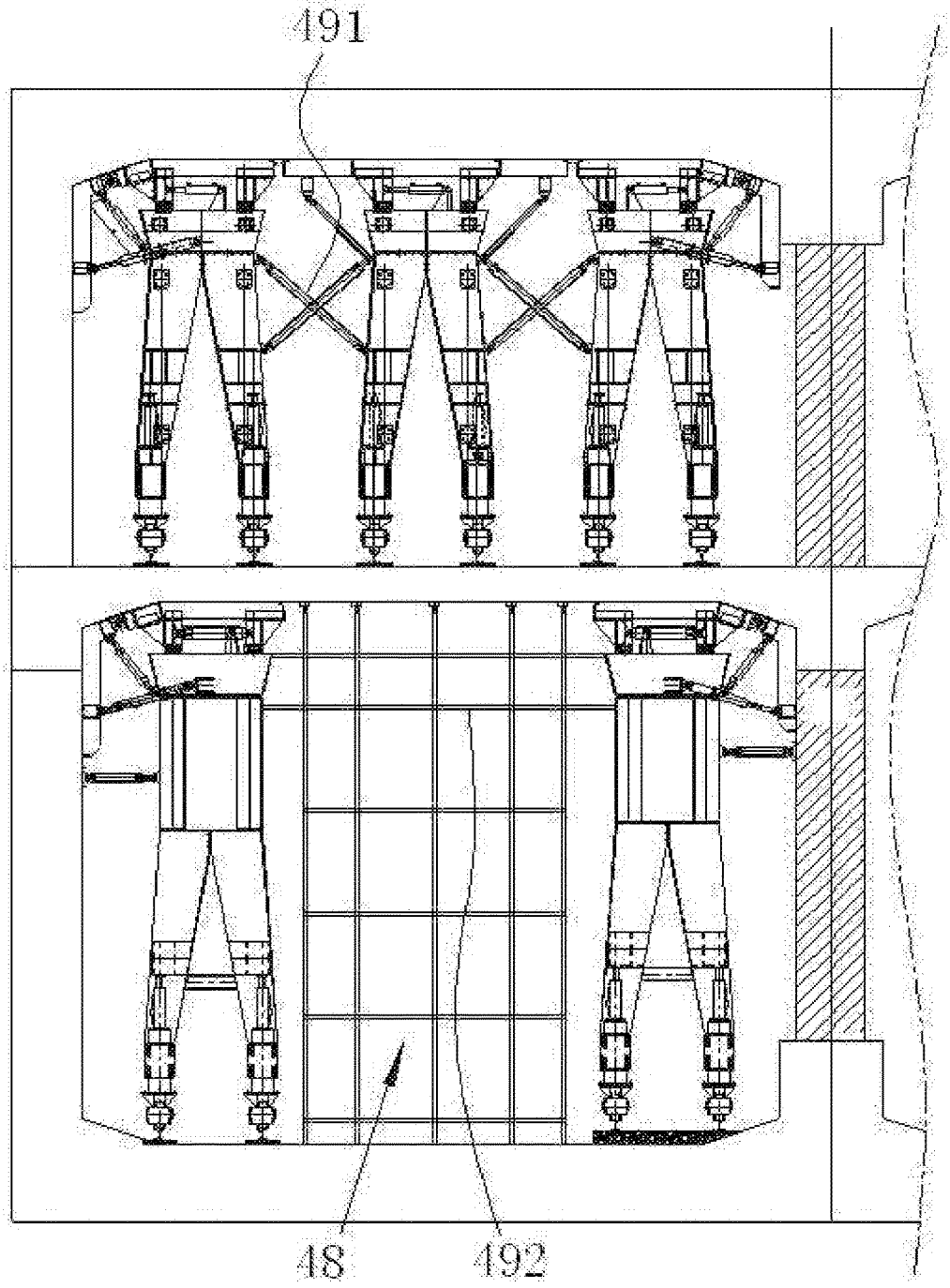
FIG. 16 shows a front view of a plurality of floor-slab trolleys for simultaneously constructing an underground first storey and an underground second storey of a subway station.

Specifically, according to the shape of the floor slabs, adjustments may be made to the aforementioned floor slab steel formwork 40. For example, in case that the two transverse sides of the floor slabs are provided with an area of sidewalls or longitudinal beam, the floor slab steel formwork 40 comprises a lateral formwork 46 having formworks for construction of sidewalls or longitudinal beam at one side, as shown in FIG. 12. When construction of the middle area of the floor slabs is performed, a middle formwork 47 with widened formwork at both sides is used, as shown in FIG. 13. In FIG. 16, there is shown the lateral formwork 46 and also the middle formwork 47. The aforementioned lateral formwork 46 is provided with a body 461 and a lateral part 462 arranged at one side of the body 461, the lateral part 462 being movably connected with the body 461 through a hinge 463, for accommodating position adjustment within the area that has lateral wall or longitudinal beam at two transverse sides. A plurality of jack screws 464 and a plurality of third hydraulic jacks 443 are provided between the lateral part 462 and the upper frame 421, whereby position adjustment of the lateral formwork 46 during formwork assembly and disassembly can be achieved via the third hydraulic jacks 443. The end surface of the lateral part 462 may be maintained in a vertical line during assembly, and the lateral part is fixed via a jack screw 464. In an embodiment, the number of the jack screws 464 is preferably ten, and the number of the third hydraulic jacks 443 is preferably six. The aforementioned middle formwork 47 comprises a body 471 and cantilevered parts 472 arranged at two sides of the body 471. The cantilevered parts 472 are used to extend the transversal width of the floor slab steel formwork 40, so as to adapt to construction conditions with different spans between two floor slab trolleys, and are connected to the body 471 via bolts. Meanwhile, by means of a plurality of jack screws 473 connected between the cantilevered parts 472 and the upper frame 421, bearing capacity of the cantilevered parts 472 during casting of concrete can be ensured, thereby improving reliability of the device as well as construction safety. In an embodiment, the number of the jack screws arranged at one side of the trolley is ten, and twenty in total for two sides of the trolley.

According to the requirements of Technical codes for safety of forms in construction (JGJ162-2008), for formwork disassembling of the bearing floor slab, when a span between members is less or equal to 2 m, the strength of the concrete should reach 50% of the designed strength, when the span is more than 2 m but less or equal to 8 m, said strength should reach 75% of the designed strength, and when the span is more than 8 m, said strength should reach 100% of the designed strength. On the premise that construction quality is ensured, in order to accelerate the construction, the overall concept of the floor slab formwork of the present invention is "making a big span into small spans". That is, a big span is made into small spans, by a floor slab trolley provided within the big span and a local post-disassembling formwork bracket, so that the formworks of the trolley system can be released comparatively fast and move to the next construction site, and the post-disassembling formwork is disassembled only after the concrete strength meet the requirement, which reduces the labor and time of building the scaffold as well as material consumption for the scaffold, and accelerates construction of the formwork trolley. Besides, the post-disassembling formwork bracket increases the bearing capacity for loads during construction.

Therefore, construction of the middle floor slab (bearing floor slab) and the top floor slab (non-bearing floor slab) by using the aforementioned floor slab trolley is performed following the steps of: (1) laying a running track 432 on the ground: according to lateral width of the construction floor slab as well as the span between floor slab trolleys, predetermining the distance between running tracks as well as between running tracks and sidewalls or longitudinal beams, laying the running track while cleaning the field, placing the floor slab trolley on the running track, and reserving space for assembly of parts of the device, (2) installing a floor slab trolley provided with the lateral formwork 46 adjacent to the sidewall or the longitudinal beam, installing a floor slab trolley provided with the middle formwork 47 for construction of a middle portion of the floor slab; it is to be understood that, when construction of the bearing floor slab (floor slab 4*b* of the underground second storey) concrete is performed by using the floor slab trolley, it is preferable that a post-disassembling formwork bracket 48 is set up between the two floor slab trolleys longitudinally parallel to each other, and construction of the floor slabs comprises the following additional step before step one: setting up the post-disassembling formwork bracket between the two floor slab trolleys longitudinally parallel to each other, (3) adjusting the elevation of the floor slab trolleys through the first hydraulic jacks 441 and the bearing jacks 445 to make top surfaces of the floor slab steel formworks of different floor slab trolleys be on a same plane, (4) performing transverse piecing of the floor slab steel formworks 40 among the floor slab trolleys by adjusting the second hydraulic jacks 442, (5) performing positioning of the lateral part 462 of the lateral formwork 46 by adjusting the third hydraulic jacks 443, (6) fixing the steel formwork 40 by mounting the jack screws 464, 473, (7) connecting two parallel floor slab trolleys through a plurality of lateral jack screws 491 or bracing steel rods 492 positioned therebetween, (8) binding reinforcing steel bars and mounting high ribbed formworks and water-stop steel plates, (9) casting concrete, disassembling the floor slab steel formworks after the concrete is solidified, and turning to a next construction cycle.

With respect to the construction steps of the floor slabs mentioned above, it is to be understood in the present embodiment that:

When construction is performed for the middle floor slab of the underground second storey, taking into account the bearing capacity of the middle floor slab of the underground second storey, the number of the floor slab trolleys, construction duration, span between floor slabs and the like, two running tracks 432 are laid on the ground of the underground second storey, each adjacent to a sidewall at one side. That is, floor slab trolleys with lateral formworks are used, with a post-disassembling formwork bracket 48 built therebetween. Therefore, when construction of the middle floor slab is performed, it is possible to build a post-disassembling formwork bracket 48 for the middle part in the next construction site in advance. According to the efficiency of the trolley at a construction section, formwork disassembly as well as assembly for a next construction cycle can be accomplished within one day by the two trolleys for each construction cycle, and the building of the post-disassembling formwork bracket 48 and laying of formworks need a time of 1.5 days. Therefore, it is necessary to accomplish the building of the post-disassembling formwork bracket 48 before formwork disassembly of the previous cycle, so as to shorten construction duration on one hand, and avoid interference with formwork disassembly and assembly when the post-disassembling formwork bracket 48 is built. In an embodiment, when concrete strength at different locations of the floor slab trolleys reaches 75% of the designed strength, the formwork trolleys at the two sides are disassembled and moved to a next construction section, which may shorten the time for formwork disassembly by using disassembly-in-advance technique and thus accelerate construction of the formwork trolley.

In construction of the top floor slab of the underground first storey, it is necessary to retain the post-disassembling formwork bracket 48 in the center of the middle floor slab of the underground second storey, so as to meet the capacity requirement of the middle floor slab during casting. Further, taking into account that the capacity requirement for the top floor slab of the underground first storey is lower than that of the middle floor slab of the underground second storey, in order to shorten the construction duration, construction is performed in an all-piecing manner by floor slab trolleys. Three running tracks 432 are laid on the ground of the underground first storey, one at each side and one in the middle, that is, it is necessary to provide two longitudinal lines of floor slab trolleys having lateral formworks 46 and one longitudinal line of floor slab trolley having a middle formwork 47, for construction. Since formworks for the top floor slab trolley are all-steel and no middle formwork bracket exists, it is necessary to reach a strength required by certain regulations during release. However, the floor slabs are separated from and can be disassembled independent of one another. Therefore, in order to shorten construction duration, when the tested strength at different locations reaches to 75% of the designed value, floor slab trolleys at two sides are first disassembled and then moved to a next construction section, and the floor slab trolley in the middle is retained as the back jacking. After assembly of the floor slab trolleys at two sides, reinforcing steel bars of the middle beam is bound. According to the construction efficiency, it takes 2-3 days for the assembly of the floor slab trolleys at the two sides and the binding of reinforcing steel bars of the middle beam to be accomplished. When the strength of the concrete reaches 100% of the designed strength, the trolley in the middle is disassembled and displaced to the next cycle. According to operation and construction efficiency of the trolley, disassembly, displacement and assembly of the trolley in the middle can be accomplished within half a day, and binding of reinforcing steel bars of the plate and treatment of reserved holes can be accomplished within one day, which may shorten construction duration effectively by using a disassembly-in-advance technique for making a big span into small spans.

Additionally, in construction of the middle floor slab of the underground second storey, since usage of the middle floor slab trolley is eliminated, in order to avoid lateral sliding or deformation of the trolley during casting due to lateral stress induced by the two lateral beams, it is necessary to provide one or more pairs of bracing steel rods 492 between the two longitudinal lines of floor slabs for lateral bracing, so that the trolley is more stably anchored onto the ground and casting at two sides is made as simultaneous as possible. In construction of the top floor slab of the underground first storey, since the middle floor slab trolley needs to be used, in order to improve the overall stability of the trolley, a plurality of lateral jack screws 491 is needed for intersected support between respective longitudinal lines of trolleys, as shown in FIG. 16. In an embodiment, in construction of the middle floor slab, the number of the bracing steel rods 492 between two longitudinal lines of floor slab trolleys is preferably ten, and in construction of the top floor slabs, the number of the lateral jack screws 491 is ten.

The present invention is disclosed with reference to preferred embodiments, and its protection scope should be considered in no way limited to these embodiments. On the contrary, the present invention is intended to cover all equivalent modifications made to the appended claims.

What is claimed is:

1. A construction system for a subway station, characterized in that the construction system comprises:

constructing two pairs of guide walls, constructing two underground continuous walls, excavating a first layer of earth, constructing a first concrete support beam, excavating a second layer of earth, constructing a second concrete support beam, continuing to excavate a layer of earth and construct a concrete support beam till an $N^{th}$ layer of earth and a steel support have been constructed, wherein N represents a positive integer number greater than or equal to 2, constructing a bottom slab, dismantling the steel support, constructing two sidewalls and a column of an underground N−1$^{th}$ storey, constructing a floor slab of the underground N−1$^{th}$ storey, dismantling an N−1$^{th}$ concrete support beam, constructing a two sidewalls and a column of an underground N−2$^{th}$ storey, constructing a floor slab of the underground N−2$^{th}$ storey, continuing to dismantle a concrete support beam and construct two sidewalls, a column and a floor slab till the second concrete support beam has been dismantled and two sidewalls, a column and a floor slab of an underground first storey have been constructed, dismantling the first concrete support beam;

wherein an enclosure-and-protection structure of the subway station is formed after the step of constructing the steel support is complete, and a main structure of the subway station is formed after the step of dismantling the first concrete support beam is complete;

the step of constructing each said underground continuous wall is performed by casting concrete down along each said pair of the guide walls to form a concrete wall structure, the step of constructing each said support beam is performed by using a support beam steel formwork system to make each said support beam into a cast-in-place steel reinforced concrete structure, each said support beam comprising a primary beam at a middle part thereof and two inclined beams at two ends thereof, each said support beam being braced between said two underground continuous walls;

the step of constructing each said sidewall is performed by using a sidewall trolley provided with a sidewall trolley moving and fixing system and a sidewall steel formwork connecting and positioning system to cast a layer of steel reinforced concrete structure on an inner surface of each said underground continuous wall;

the step of constructing each said floor slab is performed by using floor slab trolleys each provided with a floor slab trolley moving and fixing system and a floor slab steel formwork connecting and positioning system to cast a steel reinforced concrete structure having one or more interlayers between said two underground continuous walls;

wherein the sidewall trolley is a sidewall trolley unit or a combination of a plurality of sidewall trolley units pieced together longitudinally, wherein the sidewall trolley moving and fixing system of the sidewall trolley comprises a base provided with a steel column, a beam-frame assembly movably connected to the steel column, and a running system mounted below the base; two ends of the beam-frame assembly along the longitudinal axis are provided with protrusions each protruding from a middle part of the end's surface, below the protrusions are provided with a plurality of screw jacks for vertical movement of the beam-frame assembly, the screw jacks are fixed on the steel column of the base, and a bottom of the beam-frame assembly is provided with a plurality of bearing jacks, wherein the sidewall steel formwork connecting and positioning system of the sidewall trolley comprises a sidewall steel formwork formed by a plurality of steel plates which are pieced together and fixed on a formwork frame, and a plurality of telescopic cantilevers which are fixedly mounted to a side of an upper part of the beam-frame assembly which side faces the sidewall under construction; an upper longitudinal beam of the formwork frame is pin-connected with free ends of the telescopic cantilevers, a plurality of hydraulic jacks are provided between a middle longitudinal beam of the formwork frame and the beam-frame assembly, and a plurality of lateral jack screws arranged longitudinally are provided between the sidewall steel formwork and the beam-frame assembly;

wherein the step of constructing each said sidewall comprises the following steps:

step (1): laying a running track on the ground, step (2): after the step (1) is complete, coating the sidewall steel formwork with a release agent, step (3): after the step (2) is complete, placing a counterweight at a side of the sidewall trolley opposite to the sidewall steel formwork, putting the sidewall trolley on the running track, step (4): after the step (3) is complete, adjusting the screw jacks to align a lower edge of the sidewall steel formwork with a positioning line, step (5): after the step (4) is complete, repeatedly adjusting the telescopic cantilevers and the hydraulic jacks to position the sidewall steel formwork in place, step (6): after the step (5) is complete, adjusting the bearing jacks to fix the sidewall trolley, step (7): after the step (6) is complete, mounting the lateral jack screws to fix the sidewall steel formwork, step (8): after the step (7) is complete, mounting a plurality of anchor cables between a pre-buried ground anchor and the sidewall trolley, and tensioning the anchor cables towards the sidewall that is under construction, step (9): after the step (8) is complete, mounting a plurality of anti-floating jack screws to abut one end of each of the anti-floating jack screws to a top of the sidewall steel formwork and the other end to a bottom of each said support beam, step (10): after the step (9) is complete, mounting high ribbed formworks and water-stop steel plates at two longitudinal sides of the sidewall steel formwork, and step (11): after the step (10) is complete, casting concrete, disassembling the sidewall steel formwork after the concrete is solidified, and turning to a next construction cycle;

wherein the floor slab trolley is a floor slab trolley unit or a combination of a plurality of floor slab trolley units pieced together, wherein the floor slab trolley moving and fixing system of the floor slab trolley comprises a base provided with a steel column, a beam-frame assembly movably connected to the steel column, and a running system mounted below the base; wherein the beam-frame assembly comprises an upper frame and a lower longitudinal beam, two ends of the upper frame along the longitudinal axis are provided with protrusions each protruding from a middle part of the end's surface, below the protrusions are provided a plurality of first hydraulic jacks for vertical movement of the beam-frame assembly, the first hydraulic jacks are fixed on the steel column of the base, and below the lower longitudinal beam are provided with a plurality of bearing jacks, wherein the floor slab steel formwork connecting and positioning system of the floor slab trolley comprises a floor slab steel formwork formed by a plurality of steel plates which are pieced together and fixed on a formwork frame, a plurality of roller supports mounted below a back longitudinal beam of the floor slab steel formwork, a plurality of transverse tracks provided on the top of the beam-frame assembly and movably connected with the roller supports, and a plurality of second hydraulic jacks mounted on the top of the beam-frame assembly for transverse movement of the floor slab steel formwork; wherein free ends of the second hydraulic jacks are hinged with the back longitudinal beam of the floor slab steel formwork, wherein the floor slab steel formwork is a lateral formwork having a formwork at one side thereof for the construction of the sidewall or a longitudinal beam, or the floor slab steel formwork is a middle formwork having widened formworks at both sides thereof; wherein the lateral formwork is provided with a body and a lateral part arranged at one side of the body, the lateral part is movably connected with the body through a hinge; a plurality of jack screws and a plurality of third hydraulic jacks are provided between the lateral part and the upper frame of the beam-frame assembly; the middle formwork comprises a body and cantilevered parts arranged at two sides of the body, the cantilevered parts are fixedly connected with the body through bolts; a plurality of jack screws are provided between the cantilevered parts and the upper frame of the beam-frame assembly; the step of constructing the floor slabs comprises the following steps:

step (1): laying a running track on the ground, step (2): after the step (1) is complete, installing the floor slab trolley provided with the lateral formwork adjacent to the sidewall or the longitudinal beam, installing the floor slab trolley provided with the middle formwork for construction of a middle portion of the floor slab, step (3): after the step (2) is complete, adjusting the elevation of the floor slab trolley provided with the lateral formwork and the floor slab trolley provided with the middle formwork through the first hydraulic jacks and the bearing jacks to make top surfaces of the lateral formwork and the middle formwork of the floor slab trolleys be on a same plane, step (4): after the step (3) is complete, performing transverse piecing of the lateral formwork and the middle formwork of the floor slab trolleys by adjusting the second hydraulic jacks, step (5): after the step (4) is complete, performing positioning of the lateral part of the lateral formwork by adjusting the third hydraulic jacks, step (6): after the step (5) is complete, fixing the lateral formwork and the middle formwork by mounting the jack screws, step (7): after the step (6) is complete, connecting the floor slab trolley provided with the lateral formwork and the floor slab trolley provided with the middle formwork through a plurality of lateral jack screws or bracing steel rods positioned therebetween, step (8): after the step (7) is complete, binding reinforcing steel bars and mounting high ribbed formworks and water-stop steel plates, step (9): after the step (8) is complete, casting concrete, disassembling the lateral formwork and the middle formwork after the concrete is solidified, and turning to a next construction cycle.

2. The construction system for a subway station according to claim 1, characterized in that each said pair of the guide walls is constructed by a guide wall steel formwork system, the guide wall steel formwork system comprises two guide wall steel formworks arranged parallel and opposite to each other, and a movable hoisting mechanism for the guide wall steel formworks; an inner surface of each of the guide wall steel formworks is fixedly provided with a grid reinforcement rib, a surface of a side of the grid reinforcement rib is fixedly connected with a reinforcement through beam, the reinforcement through beam is provided with a U-shaped clamp, the two guide wall steel formworks are supported and connected by a plurality of jack screws provided transversely and inclinedly, two ends of each of the jack screws are respectively pin-connected with two U-shaped clamps; the movable hoisting mechanism for the guide wall steel formworks comprises a gantry having a gantry cross beam, and a crane mounted below the gantry cross beam, wherein the gantry has a column, a bottom of the column is provided with a running wheel.

3. The construction system for a subway station according to claim 1, characterized in that the support beam steel formwork system comprises a support beam steel formwork consisting of steel plates arranged parallel and opposite to each other, the support beam steel formwork comprises a primary beam steel formwork located in the middle part thereof and two inclined support beam steel formworks located at the two ends thereof, the support beam steel formwork is provided with foot supports which can be locked to the ground, the steel plates arranged parallel and opposite to each other are supported and connected by a jack screw arranged in an upper part of the steel plates, the support beam steel formwork is provided with an outer support frame which can support and abut the support beam steel formwork, the outer support frame comprises a gantry having a gantry cross beam and a column and a support rod assembly mounted across the column of the gantry for supporting the support beam steel formwork, wherein the support rod assembly comprises a support plate for abutting the support beam steel formwork and a support rod for accommodating the forward and backward movements of the support plate, the support plate is connected to an end of the support rod, the support rod is a screw passing through and threaded with the column; the step of constructing each said support beam comprises the following steps:

step (1): excavating the earth to a predetermined depth, leveling the ground, providing a base pad for the support beam to be constructed, and binding reinforcing steel bars, step (2): after the step (1) is complete, hoisting the support beam steel formwork system to a construction site of the support beam to be constructed, and coating the steel plates with a release agent, step (3): after the step (2) is complete, hoisting the steel plates to a standard construction site of support beam, hoisting and piecing together the steel plates simultaneously, wherein the hoisting and piecing together of the steel plates are started from the construction of the inclined support beam steel formwork, step (4): after the step (3) is complete, mounting the jack screw, which is in a loosened state after the mounting, and then making adjustment from the two ends of the support beam steel formwork towards the middle part thereof, till the adjustment is made properly, step (5): after the step (4) is complete, placing the outer support frame on the support beam steel formwork, pressing the gantry cross beam just on the support beam steel formwork, making the column of the gantry of the outer support frame in contact with the ground, and then adjusting the support rod to make the support plate abut the support beam steel formwork and thus the latter is prevented from moving, step (6): after the step (5) is complete, tightening the jack screw to finish the mounting of the support beam steel formwork, and step (7): after the step (6) is complete, casting concrete, and disassembling the support beam steel formwork.

4. The construction system for a subway station according to claim 1, characterized in that an additional sidewall trolley is used for simultaneously constructing said two sidewalls in a same storey, the two sidewall trolleys are connected by a plurality of bracing tubes, wherein a step as follows is comprised between the step (9) and the step (10):

assembling the plurality of bracing tubes between the two sidewall trolleys.

5. The construction system for a subway station according to claim 1, characterized in that the beam-frame assembly is formed with an upper beam-frame assembly and a lower beam-frame assembly in an overlapped way, wherein the upper beam-frame assembly is connected with the lower beam-frame assembly by means of bolts.

6. The construction system for a subway station according to claim 1, characterized in that in each construction cycle, when the strength of the concrete at different locations of the floor slab reaches a designed value, the disassembling of the floor slab steel formwork is first accomplished for the floor slab trolley provided with the lateral formwork, and then the floor slab trolley provided with the lateral formwork is moved to a next construction cycle; when the strength of the concrete reaches 100% of full strength, the floor slab trolley provided with the middle formwork is disassembled and is then moved to a next construction cycle.

7. The construction system for a subway station according to claim 1, characterized in that when the floor slab is a load-bearing floor slab, a post-disassembling formwork bracket is used to replace the floor slab trolley provided with the middle formwork.

8. The construction system for a subway station according to claim 7, characterized in that in each construction cycle, when the strength of the concrete at different locations of the floor slab reaches a designed value, the disassembling of the floor slab steel formwork is first accomplished for the floor slab trolley provided with the lateral formwork, and before disassembling the lateral formwork of the floor slab trolley provided with the lateral formwork in a construction section of the subway station, an installing of the post-disassembling formwork bracket is accomplished in a next construction section of the subway station, and the post-disassembling formwork bracket is retained until the construction of the floor slab in an upstairs storey is accomplished.

9. The construction system for a subway station according to claim 1, characterized in that an upper section of the upper frame is an overlappable frame.

* * * * *